US006431696B1

(12) United States Patent
Tajima et al.

(10) Patent No.: US 6,431,696 B1
(45) **Date of Patent: *Aug. 13, 2002**

(54) INK TANK UNIT, AN INK JET CARTRIDGE HAVING SAID INK TANK UNIT AND AN INK JET APPARATUS HAVING SAID INK JET CARTRIDGE

(75) Inventors: Hiroki Tajima, Kawasaki; Toshio Kashino, Chigasaki; Masahiko Higuma, Togane; Takeshi Okazaki, Sagamihara, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/190,120

(22) Filed: Nov. 12, 1998

Related U.S. Application Data

(62) Division of application No. 08/696,517, filed on Aug. 14, 1996, which is a continuation of application No. 08/605,587, filed on Feb. 22, 1996, now abandoned, which is a continuation of application No. 08/266,479, filed on Jun. 27, 1994, now abandoned.

(30) Foreign Application Priority Data

| | | |
|---|---|---|
| Jun. 29, 1993 | (JP) | 5-159494 |
| Jun. 30, 1993 | (JP) | 5-161135 |
| Jun. 30, 1993 | (JP) | 5-161790 |
| Aug. 2, 1993 | (JP) | 5-191379 |
| Sep. 3, 1993 | (JP) | 5-219787 |
| Jun. 8, 1994 | (JP) | 6-125965 |

(51) Int. Cl.[7] ..... B41J 2/175
(52) U.S. Cl. ..... 347/86
(58) Field of Search ..... 347/85, 86, 87; 222/187; 239/145, 44

(56) References Cited

U.S. PATENT DOCUMENTS

| | | | | |
|---|---|---|---|---|
| 4,313,124 A | | 1/1982 | Hara | 347/57 |
| 4,345,262 A | | 8/1982 | Shirato et al. | 347/70 |
| 4,459,600 A | | 7/1984 | Sato et al. | 347/47 |
| 4,463,359 A | | 7/1984 | Ayata et al. | 347/56 |
| 4,556,012 A | * | 12/1985 | Scrudato | 118/268 |

(List continued on next page.)

FOREIGN PATENT DOCUMENTS

| | | |
|---|---|---|
| DE | 4025319 | 2/1992 |
| EP | 82718 | 6/1983 |
| EP | 261764 | 3/1988 |
| EP | 378240 | 7/1990 |
| EP | 419189 | 3/1991 |

(List continued on next page.)

*Primary Examiner*—Michael Nghiem
(74) *Attorney, Agent, or Firm*—Fitzpatrick, Cella, Harper & Scinto

(57) ABSTRACT

An ink jet cartridge includes an ink jet head unit for discharging the ink, and an ink tank unit having an ink supply port for supplying the ink to the ink jet head unit. The ink tank unit has a partition portion for partitioning between an ink storing portion for storing the ink to be supplied to the ink jet head unit and a negative pressure generating member receiving portion having a negative pressure generating member. The ink supply port is provided on the negative pressure generating member receiving portion. The portion has an ink communicating portion at an end portion of the partitioning portion on the side of the negative pressure generating member receiving portion where the ink supply port is provided, and makes contiguous the ink storing portion and the negative pressure generating member receiving portion in a movement direction of the ink tank unit when discharging the ink.

27 Claims, 24 Drawing Sheets

U.S. PATENT DOCUMENTS

| | | | | | |
|---|---|---|---|---|---|
| 4,558,333 | A | | 12/1985 | Sugitani et al. | 347/56 |
| 4,723,129 | A | | 2/1988 | Endo et al. | 347/56 |
| 4,740,796 | A | | 4/1988 | Endo et al. | 347/56 |
| 4,771,295 | A | | 9/1988 | Baker et al. | 347/87 |
| 4,794,409 | A | | 12/1988 | Cowger et al. | 347/87 |
| 5,025,271 | A | | 6/1991 | Baker et al. | 347/87 |
| 5,182,581 | A | | 1/1993 | Kashimura | 347/87 |
| 5,289,212 | A | | 2/1994 | Carlotta | 347/87 |
| 5,430,471 | A | | 7/1995 | Nakajima | 347/87 |
| 5,448,275 | A | * | 9/1995 | Fong | 347/87 |
| 5,489,932 | A | | 2/1996 | Ceschin | 347/87 |
| 5,500,666 | A | | 3/1996 | Hatori et al. | 347/87 |
| 5,509,140 | A | | 4/1996 | Koitabashi et al. | 347/86 |
| 5,629,728 | A | | 5/1997 | Karita | 347/87 |
| 5,900,897 | A | * | 5/1999 | Sasaki | 347/86 |
| 6,170,941 | B1 | * | 1/2001 | Hara et al. | 347/86 |

FOREIGN PATENT DOCUMENTS

| | | |
|---|---|---|
| EP | 419192 | 3/1991 |
| EP | 424133 | 4/1991 |
| EP | 488829 | 6/1992 |
| EP | 493058 | 7/1992 |
| EP | 542247 | 5/1993 |
| EP | 581531 | 2/1994 |
| EP | 625424 | 11/1994 |
| JP | 57-16385 | 6/1955 |
| JP | 55-73623 | * 10/1980 |
| JP | 59-123670 | 7/1984 |
| JP | 59-138461 | 8/1984 |
| JP | 63-87242 | 4/1988 |
| JP | 4-156339 | 5/1992 |
| JP | 4-198474 | 7/1992 |
| JP | 4-198681 | 7/1992 |
| JP | 4-282256 | 10/1992 |
| JP | 2-522 | 1/1998 |

* cited by examiner

INK TANK UNIT, AN INK JET CARTRIDGE HAVING SAID INK TANK UNIT AND AN INK JET APPARATUS HAVING SAID INK JET CARTRIDGE

This application is a division of application Ser. No. 08/696,517, filed Aug. 14, 1996; which was a continuation of application Ser. No. 08/605,587, filed Feb. 22, 1996, abandoned; which is a continuation of application Ser. No. 08/266,479 filed Jun. 27, 1994, abandoned.

BACKGROUND OF THE INVENTION

1. Field of the Invention

The present invention relates to an ink tank unit for storing the ink to be supplied to a recording head unit for the recording by discharging the ink, an ink jet cartridge having said unit, and an ink jet apparatus which performs the recording with said cartridge mounted thereon.

2. Related Background Art

Recording apparatuses which have the features of a printer, copying machine, facsimile etc., or are useful as the output device for the complex electronic equipment including a computer or a word processor, or the work station, are configured to record the image onto the recording medium such as paper or plastic thin plate, based on image information. Such recording apparatuses can be classified into the ink jet system, the wire dot system, the thermal system and the laser beam system, depending on the recording method.

A recording apparatus of the ink jet system (an ink jet recording apparatus) performs the recording by discharging the ink from recording means (recording head) onto the recording medium, having the following advantages. The recording means can be made compact, a high definition image can be recorded at high speed, the ordinary paper can be used for the recording without any special treatments, the running cost is low, the noise is small owing to the non-impact method, and the color image is easily recorded by using color inks. In particular, a line-type recording apparatus using recording means of the line-type in which a number of discharge ports are arranged in a direction of sheet width allows the higher speed recording.

Specifically, recording means (recording head) of the ink jet system of discharging the ink by the use of heat energy can be easily fabricated with an arrangement of liquid channels (discharge ports) at high density by forming electrothermal converters, electrodes, liquid channel walls, and a celling plate as the film on a substrate through a semiconductor fabrication process such as etching, vapor deposition or sputtering, thereby allowing for the further compact construction.

An ink vessel for use in the ink jet recording apparatus is required to excellently supply the ink corresponding to an ink amount to be discharged from the recording head during the recording, and have no ink leakage through the discharge ports when the recording is not performed.

If the ink vessel is a replaceable type, the ink vessel is required to be easily mounted or demounted, without ink leakage, and surely supply the ink to the recording head.

One of the ink vessels useful for the ink jet recording apparatus is of a constitution as disclosed in Japanese Laid-Open Patent Application No. 63-87242 (hereinafter referred to as a first conventional example), that is, an ink jet recording cartridge having a plurality of ink injection orifices with a foamed member disposed within the ink vessel.

This ink vessel can store the ink in a porous medium such as polyurethane foam which is a foamed member to providing to negative pressure caused by capillary force of the foam to hold the ink therein (prevent ink leakage from the ink vessel).

Also, Japanese Laid-Open Patent Application No. 2-522 (hereinafter referred to as a second example) discloses an ink jet recording cartridge provided with a porous member between a primary ink reservoir and a secondary ink reservoir and between the secondary ink reservoir and the ink jet recording head.

In this invention, by disposing the porous member only in the ink flow passage but not containing it in the ink reservoir, the ink storable amount is increased as compared with that of the first conventional example. Also, by providing the secondary ink reservoir, the ink distribution or the air flow when the temperature rises or during the recording can be regulated to stabilize the negative pressure of the recording head.

However, since in the first conventional example, the ink storing portion needs the foam substantially over its entire area, the filling amount of the ink is restricted, with more ink unused and left in the foam, resulting in a problem that the ink use efficiency is poor. And there was a further problem that remaining amount of ink is difficult to detect, and the substantially constant negative pressure is difficult to attain during the period of consuming the ink.

Also, as seen in the first conventional example, in an ink cartridge having the form of inserting a foam into the ink storing portion, the corner portion of the foam may be distorted, depending on the way of inserting the foam, when inserting the foam, bringing about uneven compression distribution of the whole foam, with the possibility that the distribution of the ink in the ink storing portion is biased.

In this case, due to a bias of negative pressure generating power, the ink flow passage may be disrupted even if the ink is sufficiently stored, causing a discharge failure, or possibly ink leakage upon impacts as the ink is concentrated near the atmosphere communicating port. Accordingly, when inserting the foam into the ink cartridge, there is requirement for the high precision, with great restrictions on the manufacture.

On the other hand, in the second conventional example, the porous medium as a negative pressure generating member is sufficiently impregnated with the ink because a negative pressure generating member is disposed in the ink flow passage when the recording is not performed, causing insufficient generation of negative pressure with capillary force of the porous medium, resulting in a problem that ink leakage is likely to occur through orifices of the ink jet recording head by slight impact.

Also, in the technical fields of recording using the ink, there is a contact recording technique for use with the plotters. In this contact recording technique, the ink supply is typically made to a recording core or wick having ink absorbability and retainability like a felt-tipped pen.

One example of the ink supply form in the above contact recording technique is Japanese Laid-Open Utility Model Application No. 57-16385. This discloses a recording instrument pen relying on the use of a recording core (porous ink absorptive core) for recording in contact with the recording medium.

The invention which this document discloses adopts a constitution of comprising a central chamber having a recording core, a first flocculent fiber in contact with the recording core, and a second flocculent fiber having small amount of ink absorbed in the upper atmosphere communicating port side and being less permeable to the ink than the first flocculent fiber, and a closed type ink storing chamber from which the ink can be supplied via a communicating hole to either side of the central chamber.

With this constitution, the air within the closed type ink storing chamber expands due to rises in the ambient temperature, so that the ink within the closed type ink storing chamber flows into the first flocculent fiber. The ink exceeding the acceptable impregnated amount of the first flocculent fiber is impregnated by the second flocculent fiber, thereby preventing the ink overflowing from the recording core and dripping down.

Also, there is provided a groove of fixed width to cause the expanded air to escape into the atmosphere communicating port, when one of two closed type ink storing chambers is only filled with the air, the groove extending from the uppermost end to the lowermost end of a lateral surface different from that of a partition wall between the central chamber and the closed type ink storing chamber, as disclosed above.

However, in the above contact recording instrument pen, no attention is paid to the stable generation of negative pressure serving to prevent ink leakage from the recording unit in the ink jet technique which involves a non-contact recording.

Also, the consumption of the ink from the ink storing chambers on both sides is not necessarily identical, but it is pointed out that the ink of one ink storing chamber may be possibly exhausted ahead. Some attention is paid concerning the ink leakage from the recording core due to environmental changes in this case, but in the ink jet recording field, some problem such as the disruption of ink flow passage, or the penetration of air bubbles into the recording portion may occur.

To solve the above background problems, the present inventors have previously made applications for, as the ink vessel suitable for the ink jet print technical field, an ink jet cartridge having both features of the capability of supplying excellently the ink in the amount corresponding to that discharged from the recording head during printing, and the expedience of having no ink leakage from the discharge ports when the printing is not performed (Japanese Laid-Open Patent Application No. 4-198474, Japanese Laid-Open Patent Application No. 4-198681).

Herein, it has been found that the fundamental constitution effective for the ink jet characteristics is one having a first accommodating chamber which is a negative pressure generating member receiving portion having an atmosphere communicating portion for communicating to the atmosphere as well as receiving a negative pressure generating member, and a second accommodating chamber which communicates to the first accommodating chamber but lies in substantially closed state, and which is an ink storing portion for directly storing the ink to be supplied to the first accommodating chamber (hereinafter referred to as a presupposed constitution).

Because this constitution has a tank structure in which the negative pressure can be made substantially constant for most of the term from the initiation of using the head cartridge to the termination thereof, it is possible to provide a replacement-type head cartridge and an ink jet head and a printer which can cope with the high speed recording.

Further, in recent years, the ink jet recording art is not only applied to the printer, but also employed in the communication technical field such as facsimile, the copying machine field usable for the large paper (large size), and in the printing field onto cloth. With this trend, the larger capacity of the ink vessel is desired for the apparatus.

SUMMARY OF THE INVENTION

The present invention aims to increase the ink storable amount in an ink tank unit for storing the ink to be supplied to an ink jet recording apparatus, and enhance the use efficiency of the ink.

Also, the present invention aims to produce evenly the back pressure to an ink jet head unit in an ink tank unit as well as making it substantially constant, and further to facilitate the formation of an ink flow passage from the ink tank unit to the ink jet head unit to maintain the ink supply performance at high level.

Further, the present invention aims to enhance the reliability in preventing ink leakage through a discharge portion or an atmosphere communicating port portion in the ink jet cartridge.

Also, it is another object of the present invention to provide an ink jet head cartridge of the integral type which is highly reliable in preventing the ink leakage through an atmosphere communicating port portion against various changes in the attitude during physical distribution and changes in the ambient temperature and humidity, and which is inexpensive in the manufacturing costs.

To solve the above subjects, the present invention proposes a construction in which when using an ink tank unit having an ink supply port for supplying the ink to an ink jet head unit for the discharge of the ink, said ink tank unit having a partition portion for partitioning between an ink storing portion for storing the ink to be supplied to said ink jet head unit and a negative pressure generating member receiving portion having a negative pressure generating member, as well as having an ink communicating portion, on the bottom portion thereof, for communicating said ink storing portion with said negative pressure generating member receiving portion on the inner surface on which said ink supply port is provided, said partition portion allowing said ink storing portion and said negative pressure generating member receiving portion to be contiguous in a movement direction of said ink tank unit in discharging the ink.

Further, the present invention also proposes, in addition to the above construction, a construction of providing a groove (concavity) leading to said ink communicating portion on said negative pressure generating member receiving portion side of said partition portion, or a construction of providing a concave (recess) portion between said ink supply port portion of said negative pressure generating member receiving portion and said ink supply port portion.

Also, the present invention proposes a further construction in which when using an ink tank unit having an ink supply port for supplying the ink to an ink jet head unit for the discharge of the ink and an atmosphere communicating portion for communicating the inside to the atmosphere, said ink tank unit has an ink storing portion for storing the ink to be supplied to said ink jet head unit and a negative pressure generating member receiving portion for communicating via an ink communicating portion to said ink storing portion as well as having a negative pressure generating member, said atmosphere communicating portion and said ink supply port being disposed in said negative pressure generating member receiving portion, said atmosphere communicating portion having one aperture, said aperture having a barrel portion extending from the inside of said ink tank to the inner surface of a wall portion and deadlocked near the outer surface of the wall portion, and an opening portion divided into branches from a deadlocked portion of said barrel portion.

Further, the present invention also proposes, in addition to the above construction, a construction in which a groove extening from said opening portion of said aperture is formed on the outer surface of an ink tank unit on which an outer opening of said atmosphere communicating portion is provided, and said groove and said opening portion are covered with a seal member having a shorter width than the length of said groove.

By adopting the previous constructions, the volume of ink storing portion for directly storing the ink within the ink jet cartridge can be increased, so that the use efficiency of the ink can be enhanced. The ink supply can be stabilized because the ink is supplied via the ink communicating portion, with the ink leakage through the atmosphere communicating port prevented.

To further enhance the stability of the ink supply, a groove portion in the partition portion, or a recess portion on the bottom portion of negative pressure generating member receiving portion may be provided to adjust the ink amount within the negative pressure generating member receiving portion or increase the width of ink flow passage.

BRIEF DESCRIPTION OF THE DRAWINGS

FIGS. 1A and 1B are views showing one embodiment of an ink jet cartridge, in which FIG. 1A is a schematic perspective view and FIG. 1B is a perspective view.

FIGS. 4A and 4B are views showing an ink jet cartridge according to an embodiment 3 of the present invention, in which FIG. 4A is a cross-sectional view of the inside along the ink discharge direction and FIG. 4B is a cross-sectional view of the inside along the main scan direction of the ink jet cartridge.

FIGS. 5A and 5B are views showing an ink jet cartridge according to an embodiment 4 of the present invention, in which FIG. 5A is a cross-sectional view of the inside along the ink discharge direction and FIG. 5B is a cross-sectional view of the inside along the main scan direction of the ink jet cartridge.

FIGS. 7A and 7B are views showing an ink jet cartridge according to an embodiment 5 of the present invention, in which FIG. 7A is a cross-sectional view of the inside along the ink discharge direction and FIG. 7B is a cross-sectional view of the inside along the main scan direction of the ink jet cartridge.

FIGS. 8A and 8B are views showing an ink tank unit according to an embodiment 6 of the present invention, in which FIG. 8A is a cross-sectional view of the ink tank unit, and FIG. 8B is a cross-sectional view the tank of FIG. 8A taken along the line X—X, which is a schematic view with a negative pressure generating member 205 as shown in FIG. 8A removed to better represent the features of this embodiment.

FIGS. 10A and 10B are views showing an ink jet cartridge according to an embodiment 7 of the present invention, in,which FIG. 10A is a cross-sectional view of the inside along the ink discharge direction and FIG. 10B is a cross-sectional view of the inside along the main scan direction of the ink jet cartridge.

FIGS. 12A and 12B are views showing an ink jet cartridge according to an embodiment 8 of the present invention, in which FIG. 12A is a cross-sectional view of the inside along the ink discharge direction and FIG. 12B is a cross-sectional view of the inside along the main scan direction of the ink jet cartridge.

DETAILED DESCRIPTION OF THE PREFERRED EMBODIMENTS

The present invention will be described in detail using the drawings. Note that the "negative pressure" as referred to in the present invention is a back pressure applied to an ink jet head unit (hereinafter also referred to as a recording head unit) in a direction of the ink supply, by which the water head at an ink discharge portion provided on the ink jet head unit is made lower than the atmospheric pressure.

Figure 1A:
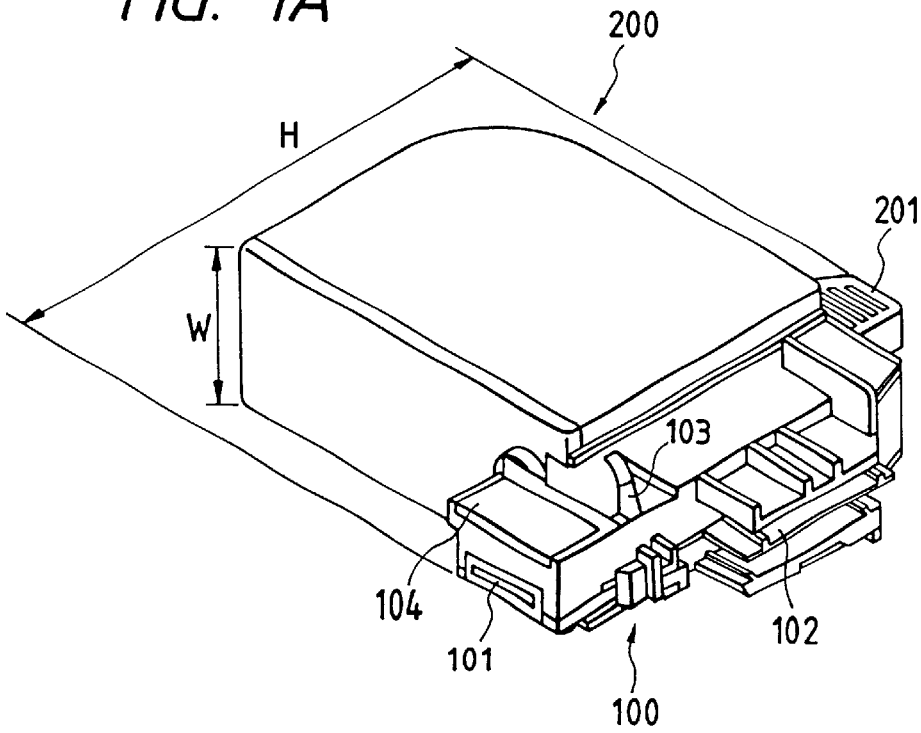
Figure 1B:
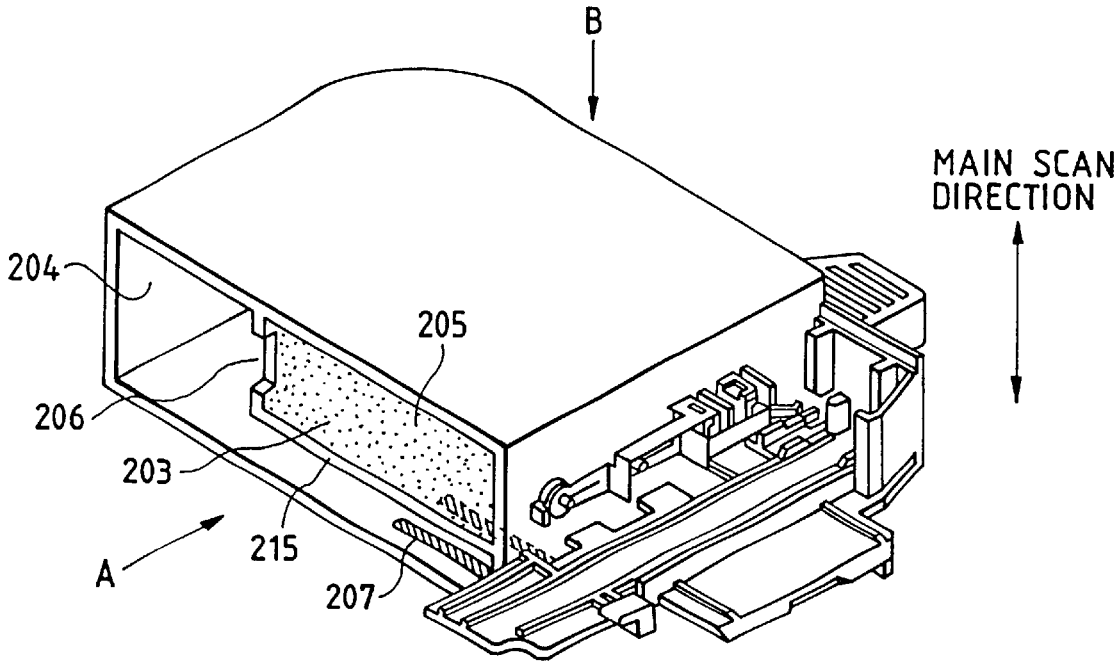

FIGS. 1A and 1B show one embodiment of an ink jet cartridge which is mountable on a carriage of an ink jet recording apparatus. FIG. 1A is an external perspective view of the ink jet cartridge of the present invention, and FIG. 1B is a perspective projection view of an ink tank unit, with the recording head unit removed from the ink jet cartridge as shown in FIG. 1A, as seen through one lateral side (which corresponds to the bottom face of the ink tank unit which is an ink reservoir in this embodiment).

Herein, 200 is an ink tank unit (ink cartridge) which is an ink reservoir for storing the ink, and 100 is a head unit for performing the recording by discharging the ink through the discharge ports 101.

Note that in the present invention, an ink tank unit and a head cartridge connected together is referred to as an ink jet cartridge.

The ink jet cartridge in this embodiment has an ordinary ink tank unit 200 and a head unit 100 connected, as shown in FIG. 1A, and is detachably mounted on a carriage (not shown) of the ink jet recording apparatus, with a discharge port portion 101 faced downward. Note that in the ink jet cartridge of this embodiment, the head unit 100 as shown in FIG. 1B can be detached from the ink tank unit 200.

102 is a wiring connector for accepting the signal for driving the ink discharge portion 101 of the head unit 100, as well as outputting an ink remaining amount sensing signal, this wiring connector being connected to a wiring connector (not shown) on the ink jet recording apparatus side. This wiring connector 102 is provided along the lateral side of the head unit 100 and the ink tank unit 200, that is, along the vertical direction in mounting the carriage as will be described later.

103 is a pin engagement portion provided on the head unit 100 to engage a pin provided on the carriage side when mounting the ink jet cartridge on the ink jet recording apparatus. With this pin engagement portion 103, the ink jet head unit 100 can be positioned.

When mounting the ink jet cartridge on the carriage, a knob 201 provided on the ink tank unit 200 is grasped, with the discharge portion 101 directed downward, to mount the ink jet cartridge at a predetermined position on the carriage. Accordingly, splashing or sticking of the ink to the apparatus or the undischarge will not occur even if the user touches the ink discharge portion by mistake, when removing or replacing the ink jet cartridge.

104 is a head side absorbing member provided for the recovery of recovery member for the ink discharge port portion 101 provided on the ink jet head unit 100, the details of which will be described later.

The ink tank unit 200 is comprised of a negative pressure generating member receiving portion 203 which is a negative pressure generating chamber and an ink storing portion 204, the negative pressure generating chamber having inserted thereinto a porous ink absorbing member 205 which is a negative pressure generating member. Between the negative pressure generating member receiving portion 203 and the ink storing portion 204 is provided an ink communicating portion 206.

The ink storing portion 204 has a pair of electrode pins installed therein for use in sensing the remaining amount of the ink. The ink storing portion 204 is configured such that the ink storing portion and the negative pressure generating member receiving portion are disposed contiguously along a vertical direction to the main scan direction as a whole by providing a partition portion 215 (partition wall) of an L-character shape as seen from the A direction of FIG. 1B.

Since the ink storing portion 204 is partitioned by the partition portion with the longitudinal direction of the ink storing portion 204 being perpendicular to the main scan direction along which the ink jet cartridge moves as a whole in discharging the ink, the ink tank unit is reduced in size while the ink capacity is increased simultaneously, with the vibration of the ink inside suppressed in making the main scan for the recording.

Note that in this embodiment, the ink storing portion has one and half or more the volume of the negative pressure generating member receiving portion, wherein the greater ink capacity is achieved by increasing the ratio of the ink storage to the volume of the ink storing portion of the ink vessel, as compared with the conventional constitution of the ink storing portion for storing the ink using only an ink absorbing member.

Figure 2A:
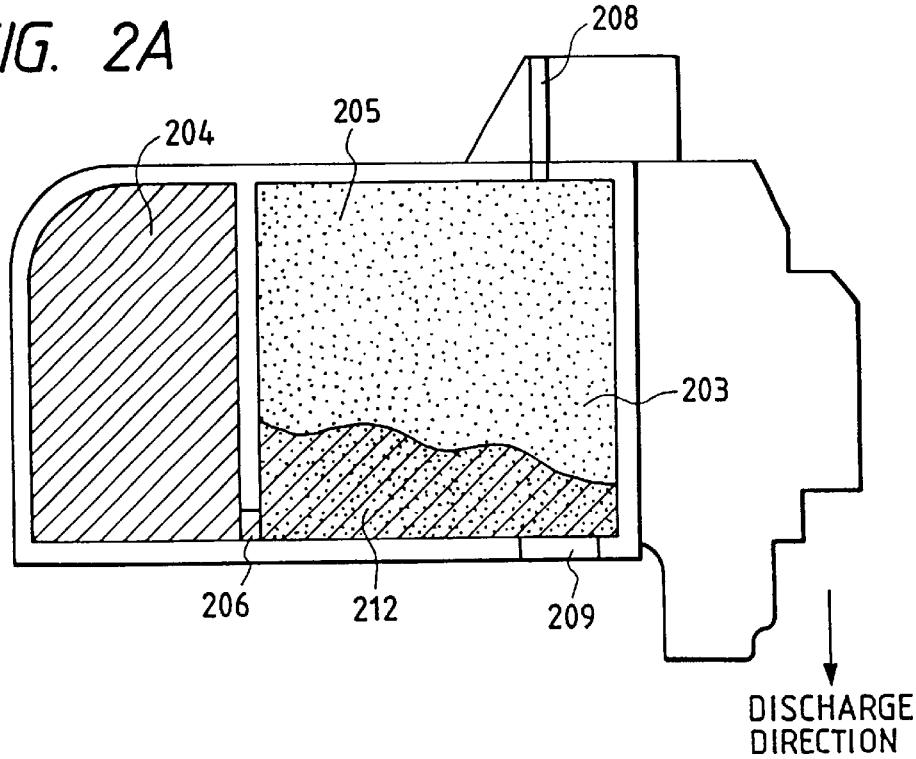
FIG. 2A is a cross-sectional view of a unit of FIG. 1B as looked from the B direction in FIG. 1B.
Figure 2B:
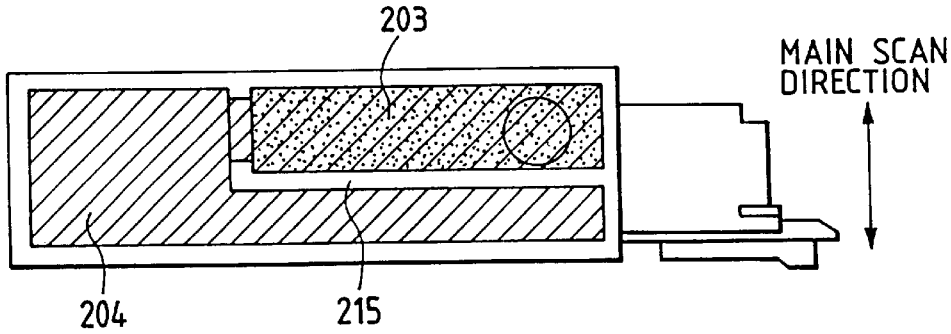
FIG. 2B is a perspective cross-sectional view of the unit of FIG. 2A as looked from the discharge port side.

Referring now to FIGS. 2A and 2B the state where the ink is stored within the ink jet cartidge will be described below. FIG. 2A is a cross-sectional view of a unit of FIG. 1B as looked from the B direction in FIG. 1B. FIG. 2B is a perspective cross-sectional view of the unit of FIG. 2A as looked from the discharge port side.

In FIG. 2A, the ink discharge from the head unit is performed in a downward direction in the figure, wherein an ink supply port 209 is located on the bottom side when the ink jet cartridge is mounted on the ink jet recording apparatus. An atmosphere communicating port 208 and the ink supply port 209 are disposed on the opposite upper and lower surfaces, respectively, within the negative pressure generating member receiving portion, with the ink absorbing member 205 which is a negative pressure generating member interposed therebetween.

The ink supply from the ink storing portion 204 to the negative pressure generating member receiving portion 203 is carried out in response to pressure changes upon the ink consumption of the head unit (not shown).

Normally, since there is the ink within the negative pressure generating member receiving portion, the ink storing portion 204 is in the closed state, so that the internal pressure will decrease with the ink supply.

And the pressure within the ink storing portion 204 decreases with the ink consumption, but because the negative pressure generating member receiving portion is opened to the atmosphere, the gas-liquid interface within the receiving portion will drop, finally allowing the air to enter the ink storing portion 204 via the ink communicating portion 206, bringing about the gas-liquid exchange.

Herein, with too small spacing of the ink communicating portion 206, the meniscus force is so great that the ink supply from the ink storing portion to the negative pressure generating chamber is not allowed, this spacing being preferably about 3 mm, considering from the pore diameter (substantially 0.1 mm) of a porous member as the ink absorbing member receivable within the negative pressure generating chamber. In this embodiment, this spacing was 2 mm.

As shown in FIGS. 2A and 2B, since the ink supply port 209 is located on the bottom side in making the ink discharge, the positional relation between the ink communicating portion 206 and the ink supply port 209 at the time of ink discharge is such that the ink supply port 209 is lower in level than the ink communicating portion 206 with respect to the gravitational direction.

Accordingly, before the ink level within the negative pressure generating chamber falling with the ink consumption within the negative pressure generating portion reaches a point provided on the ink supply port 209, the ink within the ink storing portion 204 is supplied via the ink communicating portion 206 to the negative pressure generating member receiving portion 203, so that the ink within the ink storing portion can be completely used, causing no ink interruption, with the enhanced use efficiency of the ink attained.

Considering from the aspect of the ink interruption, the ink communicating portion may be provided anywhere as far as the previously-described positional relation is met with respect to the ink supply port. However, taking into consideration the fluctuation of the ink within the ink storing portion, it is preferable to supply the ink from the ink storing portion to the negative pressure generating member receiving portion in a direction orthogonal to the main scan direction.

In this embodiment, as shown in FIGS. 2A and 2B, owing to the provision of the ink communicating portion on a wall of the partition portion parallel to the main scan direction, a more preferable form of stable ink supply can be attained without influence from the fluctuation of the ink within the ink storing portion.

Figure 3:
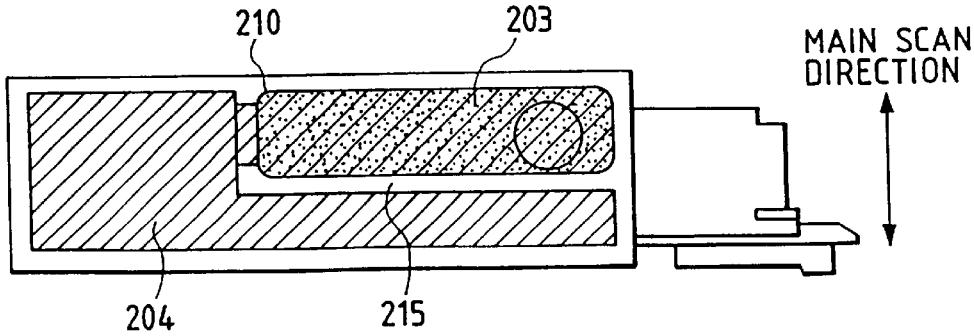
FIG. 3 is a view showing an ink tank unit according to an embodiment 2 of the present invention.

FIG. 3 shows one example of an ink tank unit according to an embodiment 2. This embodiment offers a constitution for further stabilizing the ink storing state within the negative pressure generating member receiving portion 203 as shown in the embodiment 1.

In this embodiment, as shown in FIG. 3, the negative pressure generating member receiving portion 203 is rounded at the four corners 210 within the negative pressure generating member receiving portion 203. With this curved profile, the absorbing member can press evenly at the four corners so that no exfoliation or distortion occurs at the edge corners of the ink absorbing member 205 due to the friction, avoiding the ink concentration on the locally deformed portion.

Accordingly, the possibility of the ink flow passage formed in the ink concentrated portion can be further reduced, resulting in stabler ink distribution to collect the ink only near the ink supply port 209 more securely.

Further, the ink absorbing member near the atmosphere communicating port is not wet by the ink, and lower in wettability (less likely to be wet) than when it is wet by the ink.

Thereby, the ink within the ink absorbing member is difficult to migrate toward the atmosphere communicating port, creating a very strong structure against the ink wetness. Hence, the absorbing member 205 near the atmosphere communicating port can be utilized as the buffer.

While in this embodiment, curvature is provided at the four corners, it is noted that multi-angle may be made to eliminate the angle at the four corners to prevent exfoliation. However, the depicted profile of the corners 210 is most preferable from the aspect of the insertion precision or even insertion.

Figure 4A:
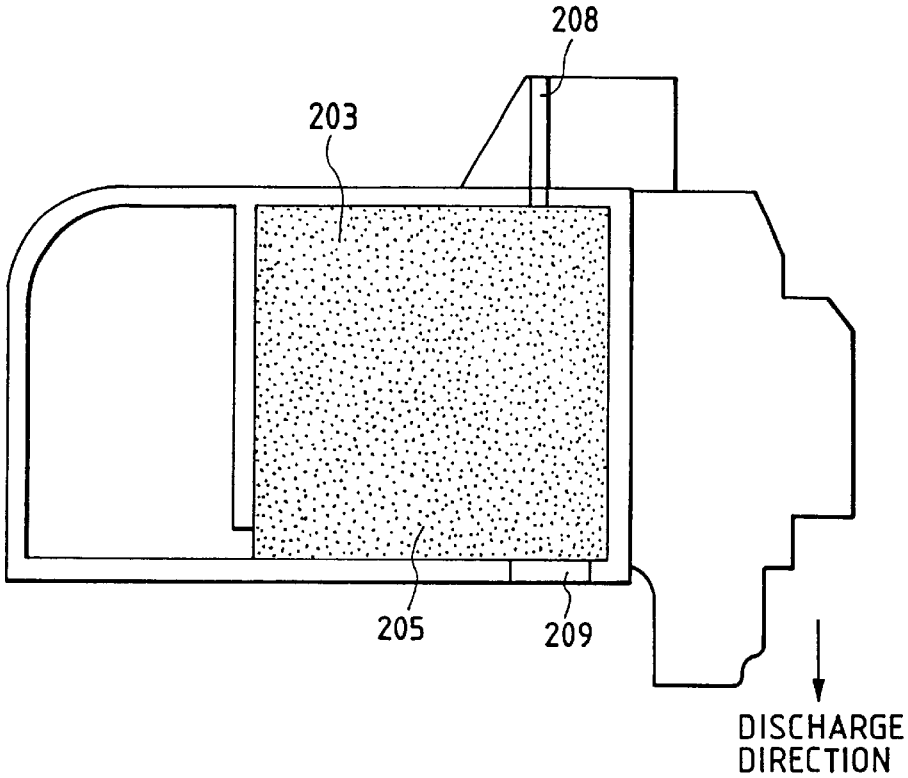
Figure 4B:
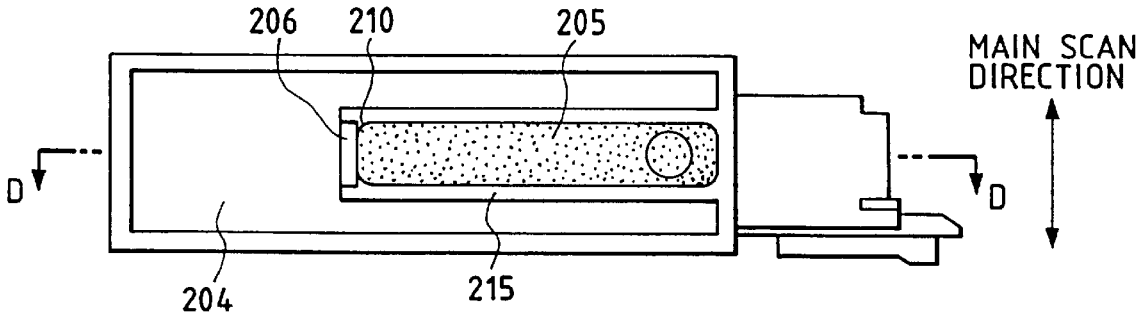

FIGS. 4A and 4B show internal structures of another ink tank unit for use in the ink jet cartridge of the present invention which is mounted on the ink jet recording apparatus according to an embodiment 3. In the figure, like symbols are attached to the parts having the same functions as in the previous embodiment 1.

FIG. 4A is a cross-sectional view of the inside along the ink discharge direction, and FIG. 4B is a cross-sectional view of the inside along the main scan direction of the ink jet cartridge. Herein, FIG. 4A corresponds to the D—D cross-sectional view in FIG. 4B.

As seen from FIG. 4B, an ink storing portion is extended on both sides of negative pressure generating member receiving portion along a direction crosswise to the main scan direction when mounting the ink cartridge by a partition portion 215 in this cartridge, with the ink storing portion like a U-character. In this embodiment, like the previous embodiment 1, the direction of supplying the ink via the ink communicating portion 206 from the ink storing portion to the negative pressure generating member receiving chamber is made a longitudinal direction of the ink storing portion, so that the ink storing amount is increased.

As above described, with such U-character structure where the longitudinal direction of the ink storing portion is orthogonal to the main scan direction, the fluctuation of the ink due to the movement of the cartridge in the main scan direction can be suppressed, like the previous embodiment 1. In this embodiment, the ink communicating portion 206 is provided in the central portion of the partition portion 215 of U-character shape, i.e., on the wall along the main scan direction of the partition portion 215, whereby the effects of the ink fluctuation can be further avoided.

Figure 5A:
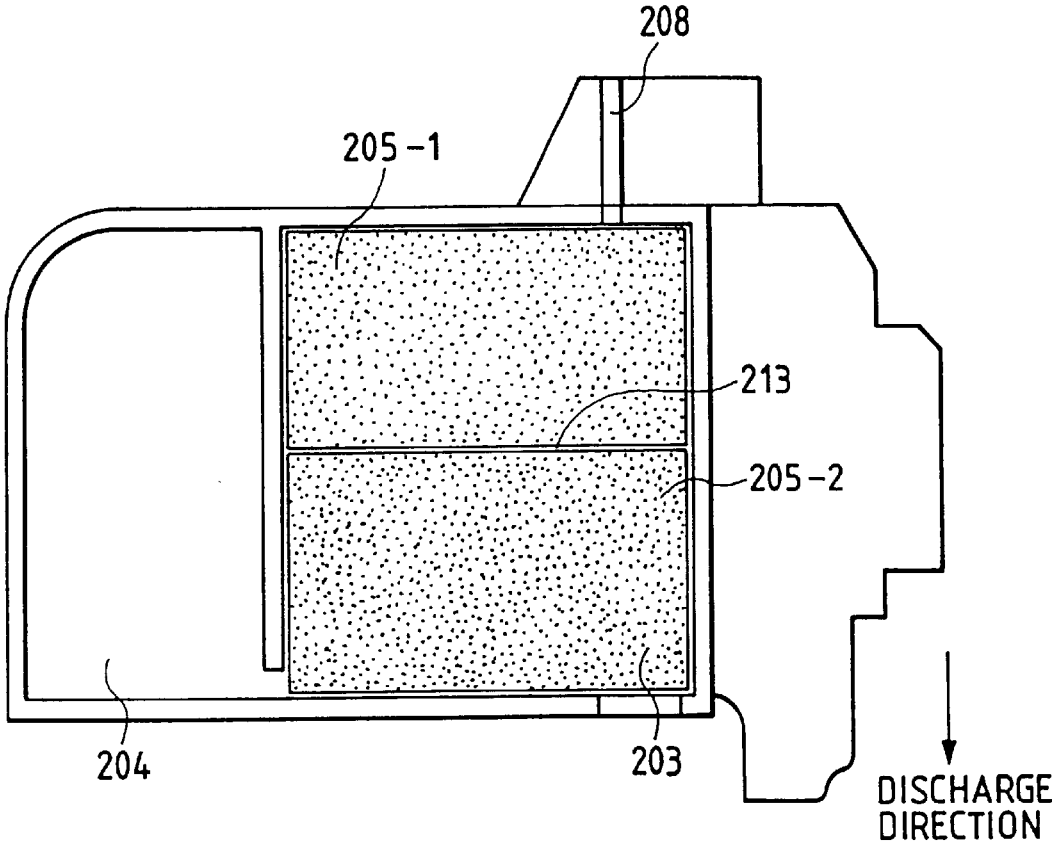
Figure 5B:
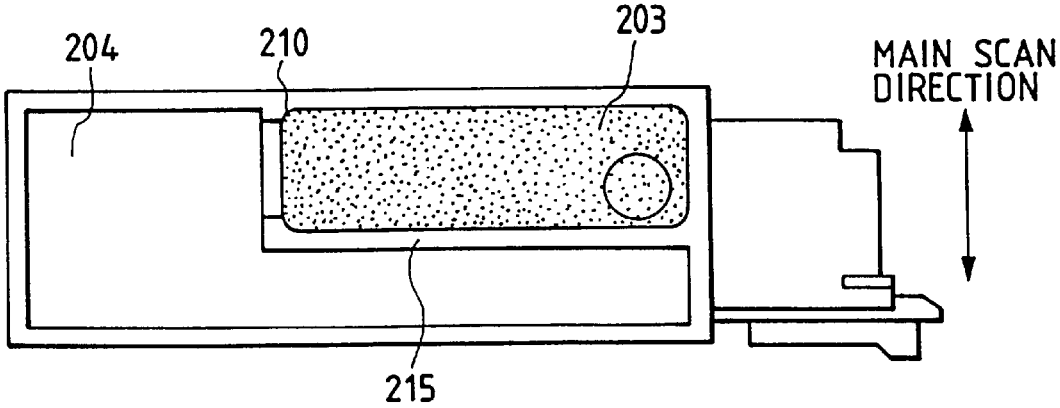

FIGS. 5A and 5B show the internal structures of another ink tank unit for use in the ink jet cartridge of the present invention as an embodiment 4. In this figure, like symbols are attached to the parts having the same functions as in the previous embodiment.

FIG. 5A is a cross-sectional view of the inside along the ink discharge direction and FIG. 5B is a cross-sectional view of the inside along the main scan direction of the ink jet cartridge.

In this embodiment, as shown in FIG. 5A, an absorbing member 205 within the negative pressure generating member receiving portion 203 is divided into two portions 205-1 and 205-2, and a gap 213 serving as a meniscus generating portion is provided so that a meniscus may be formed between these portions 205-1 and 205-2.

Upon the ink reaching this gap portion, a meniscus is formed therein so that the movement of the ink from an ink absorbing member 205-2 to an ink absorbing member 205-1 is made difficult.

Accordingly, by adopting the constitution of this embodiment, the wetting with the ink from the atmosphere communicating port 218 can be prevented at higher reliability.

Figure 6:
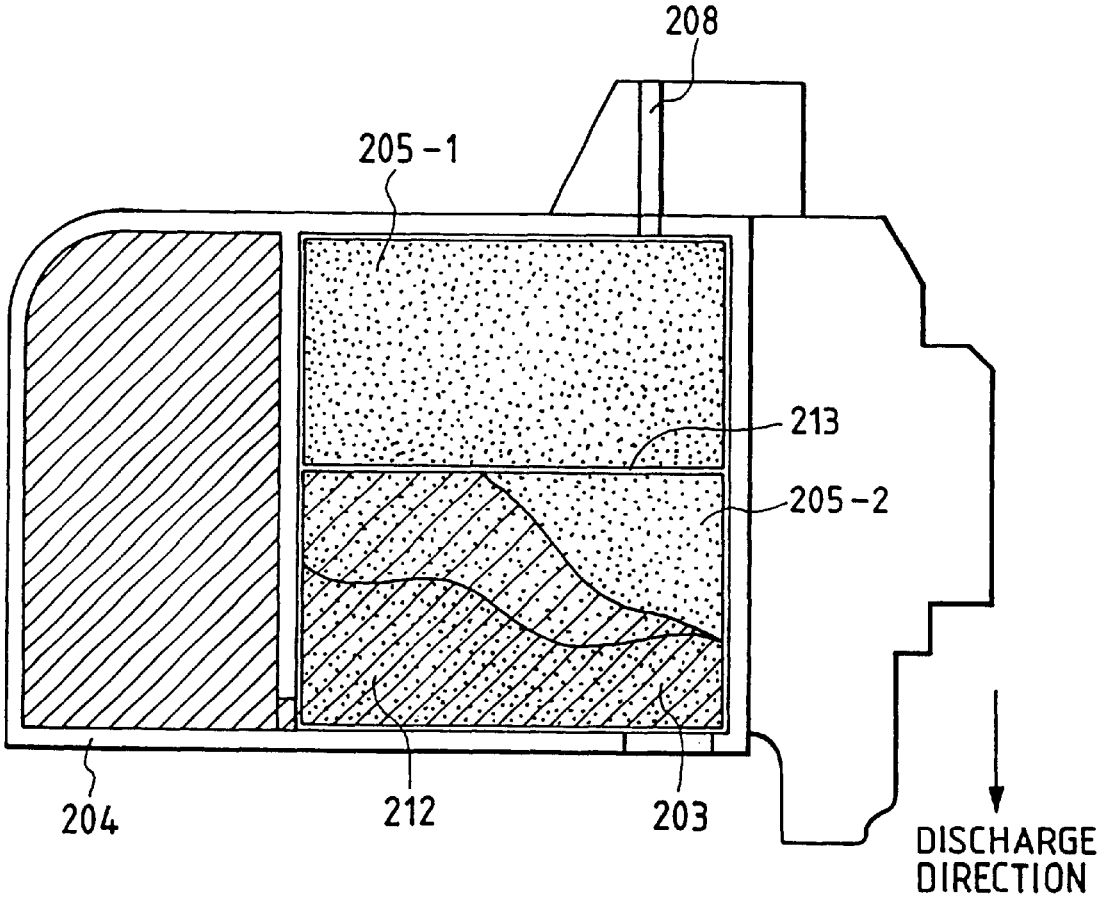
FIG. 6 is a view showing the state of holding the ink in the ink cartridge of FIGS. 5A and 5B.

FIG. 6 shows an instance where the ink is filled in the ink jet cartridge of this embodiment. In this case, even if the expanded ink wets the whole portion of 205-2 in reducing the pressure or maintaining high temperature, the ink is held by the meniscus generating portion 213, and the ink is difficult to flow to the portion 205-1, so that the ink leakage from the atmosphere communicating port 208 is less likely to occur.

Figure 7A:
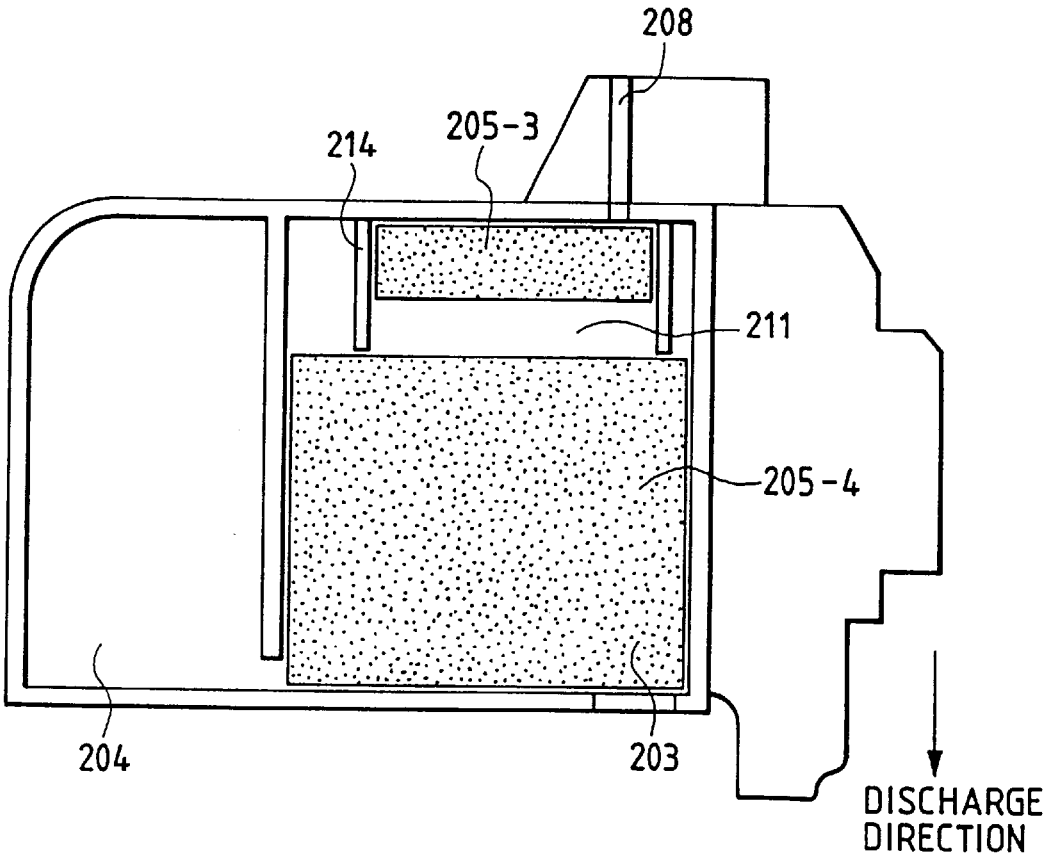
Figure 7B:
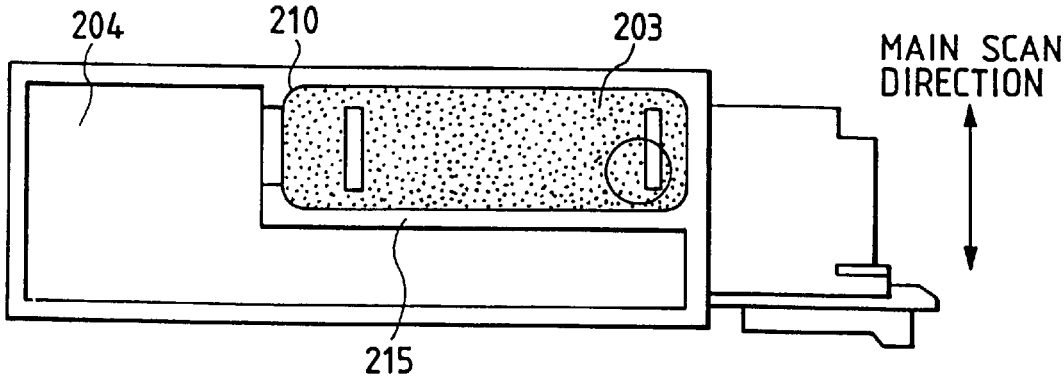

FIGS. 7A and 7B show the internal structures of another ink tank unit for use in the ink jet cartridge of the present invention which is mounted on the ink jet recording apparatus, as an embodiment 4. In this figure, like symbols are attached to the parts having the same functions as in the previous embodiment.

FIG. 7A is a cross-sectional view of the inside along the ink discharge direction and FIG. 7B is a cross-sectional view of the inside along the main scan direction of the ink jet cartridge.

In this embodiment, as shown in FIG. 7A, like the embodiment 4, two divided portions 205-3 and 205-4 are provided within the negative pressure generating member receiving portion 203. A different point from the previous embodiment 4 is that a buffer chamber 211 communicating to the atmosphere communicating port 208 within the negative pressure generating member receiving portion is provided adjacent the ink absorbing member 205-4 as negative pressure generating means.

This buffer chamber is secured within the negative pressure generating member receiving portion by a rib 214 to store the ink overflowing from the ink absorbing member due to environmental changes as previously described, preventing the ink from reaching the atmosphere communicating port portion.

Further, in this embodiment, by disposing an ink absorbing member 205-3 between two absorbing member stop ribs 214, the ink overflowing into the buffer chamber is prevented from directly reaching the atmosphere communicating port 208.

In this embodiment, the reliability in preventing the ink leakage is enhanced by virtue of this buffer chamber.

A constitution other than preventing the ink leakage through the atmosphere communicating port portion by changing the form of receiving the negative pressure generating member within the negative pressure generating member receiving portion as previously described is shown below.

Figure 8A:
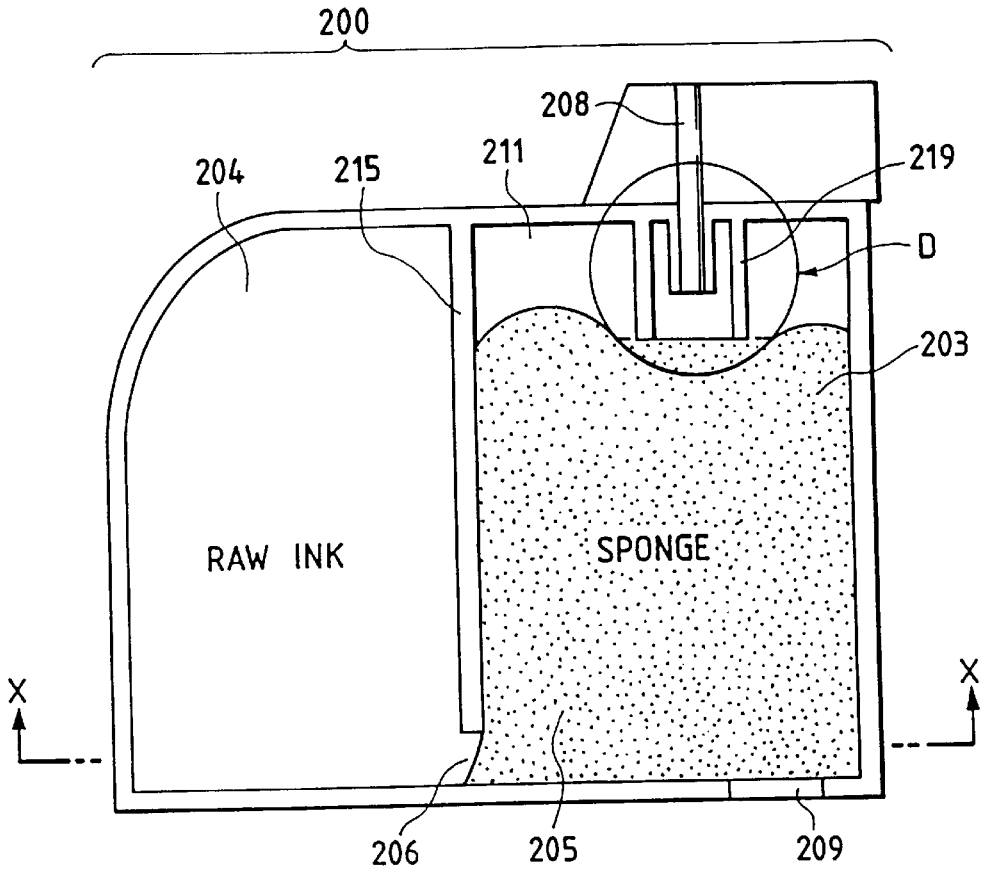
Figure 8B:
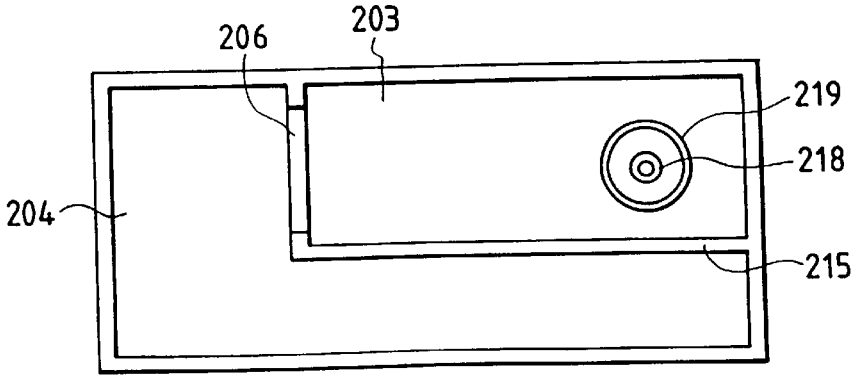

FIGS. 8A and 8B are views showing an ink tank unit according to this embodiment, in which FIG. 8A is a cross-sectional view of the ink tank unit, and FIG. 8B is a schematic cross-sectional view of the tank taken along the line X—X, with the negative pressure generating member 205 removed to better represent the features of this embodiment.

Figure 9A:
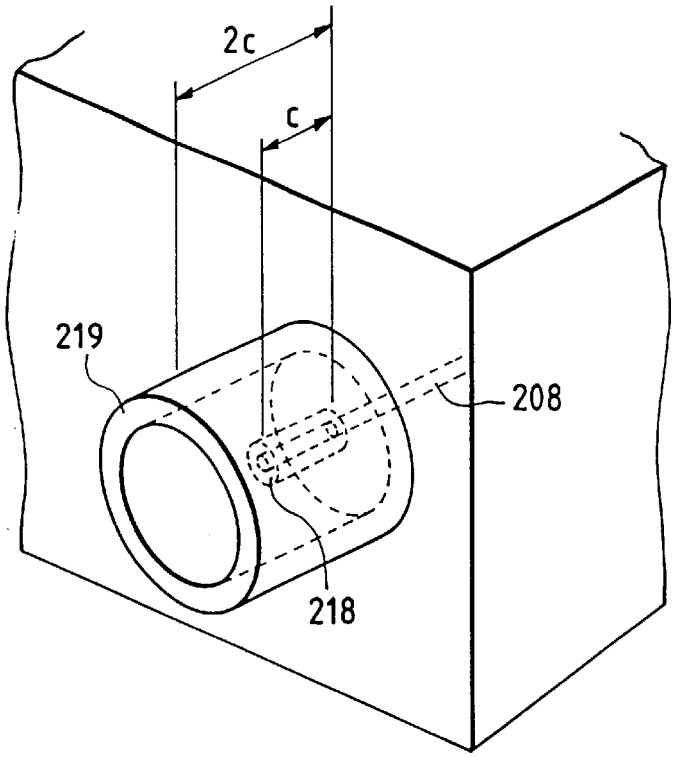
FIG. 9A is a detail view of a portion D of FIG. 8A, and FIG. 9B variation of the portion D of FIG. 8A.

FIG. 9A is a detail view showing a portion D of FIG. 8A. In this embodiment, an atmosphere communicating passage of which the end portion is projected into negative pressure generating member receiving portion 203 is used, and further, a partition wall 219 is provided around the periphery of atmosphere communicating passage, as shown in FIGS. 8A to 9A.

Herein, when the height of a projected atmosphere communicating port portion 218 is assumed to be c, the height of the partition wall 219 which is an annular projection provided circumferentially thereof is made 2*c* or greater, with a gap 211 formed as a buffer chamber between negative pressure generating member (ink absorbing member) 205 and a projection 218 of atmosphere communicating port, thereby preventing the ink leakage through the atmosphere communicating port portion.

Further, the outside annular partition wall 219 is spaced away from a projected tubular end portion 218 of the atmosphere communicating port not to be in contact therewith, and even if the ink leakage occurs from the negative pressure generating member 205, no leaked ink passes along the partition wall 219 into the atmosphere communicating port portion 218.

However, in this case, it is desired that the interval provided between both projections is set to be large enough to cause no capillary phenomenon, thereby reducing the possibility that the ink sticking to the partition wall reaches an opening portion at the end of the atmosphere communicating port portion.

Figure 9B:
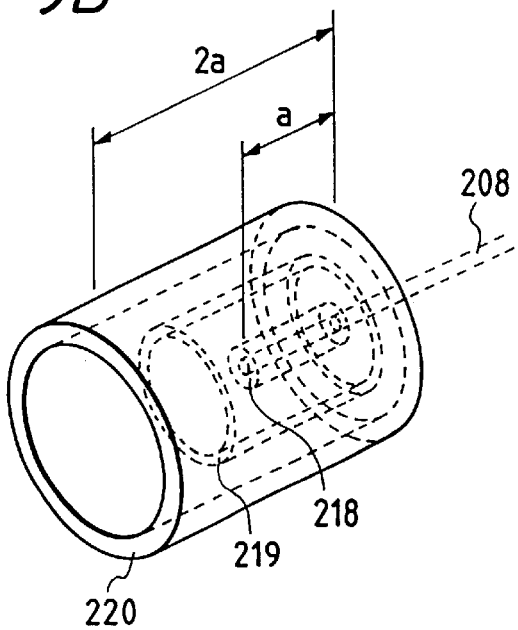

It will be appreciated that the atmosphere communicating port portion within the negative pressure generating member receiving portion is of a triple structure, with increasing height of the partition wall in more outside, as shown in FIG. 9B.

Where the length of an innermost projection or a projection portion 218 of the atmosphere communicating port portion is assumed to be c, the length of the outermost annular projection 220 is made 2*c* or greater (e.g., 3*c*). Thereby, the reliability in preventing the ink leakage through the atmosphere communicating port is further increased.

Besides the above embodiments, modifications such as a quadruple or more multi-structure may be made within the scope of the present invention to enhance the reliability in presenting the ink leakage.

In this embodiment, the atmosphere communicating port portion within the negative pressure member receiving portion of the ink tank unit is made the above structure, forming a clearance as the buffer chamber between the ink absorbing member and the surface provided with the atmosphere communicating port, and further preventing the ink from the partition wall constituting the buffer chamber reaching the opening portion at the end of the atmosphere communicating port portion to increase the reliability in preventing the ink leakage through the atmosphere communicating port portion.

Further, even if the ink enters inside the annular projection, the ink is trapped prior to reaching the innermost projection of the atmosphere communicating port, whatever attitude the ink jet cartridge is placed in, because the annular projections are spaced part, thereby enhancing the reliability of ink leakage prevention.

In embodiments as previously described, an ink tank unit has been proposed which is comprised of a negative pressure generating member receiving portion (ink absorbing member receiving portion) having an ink supply port in communication with the recording head and receiving a negative pressure generating member (ink absorbing member) and an ink storing portion contiguous to and in communication with the absorbing member receiving portion via an ink communicating portion on its bottom side in order to accomplish simultaneously the enhanced use efficiency of the ink and the proper generation of negative pressure force.

In the above constitution, the ink supply from the ink storing portion to the negative pressure generating member receiving portion is made in such a process that the ink within the ink storing portion 204 is supplied via the ink communicating portion 206 to the negative pressure generating member receiving portion 203 when the ink level near the partition portion 215 decreases at least to the ink communicating portion 206 of the partition portion 215 by the ink consumption within the negative pressure generating portion.

The ink level in the negative pressure generating member receiving portion necessarily decreases because the ink communicating portion communicating to the ink storing portion lies on the bottom of the partition portion 215. However, the compression of the absorbing member received within the negative pressure generating member receiving portion is difficult to become even in practice, and the decreasing ink level is not necessarily uniform.

On the other hand, because the negative pressure generating member has a function of holding the ink, the ink level within the negative pressure generating member receiving portion will rise again, if the ink is supplied from the ink storing portion. Accordingly, there is the possibility that the amount of ink held above the ink supply port 209 within the negative pressure generating member receiving portion is not always constant.

The negative pressure generated by the ink absorbing member is possibly affected by the weight of the ink itself within the negative pressure generating member receiving portion. In particular, when the ink supply port portion 209 for communicating to the recording head is provided on the bottom portion of the negative pressure generating member receiving portion, as in the previous embodiment, the variation in the ink amount will cause a variation in the negative pressure.

In this case, by increasing the gap of the ink communicating portion between both receiving portions, the ink level can not be adjusted. Because the increased gap prevents the formation of ink meniscus in the ink communicating portion, the ink is supplied excessively to the absorbing member receiving portion, causing the negative pressure within the absorbing member to decrease extremely, resulting in a risk that ink leakage may occur.

In the following embodiment, one constitution to enhance the stability of this negative pressure will be proposed.

Figure 10A:
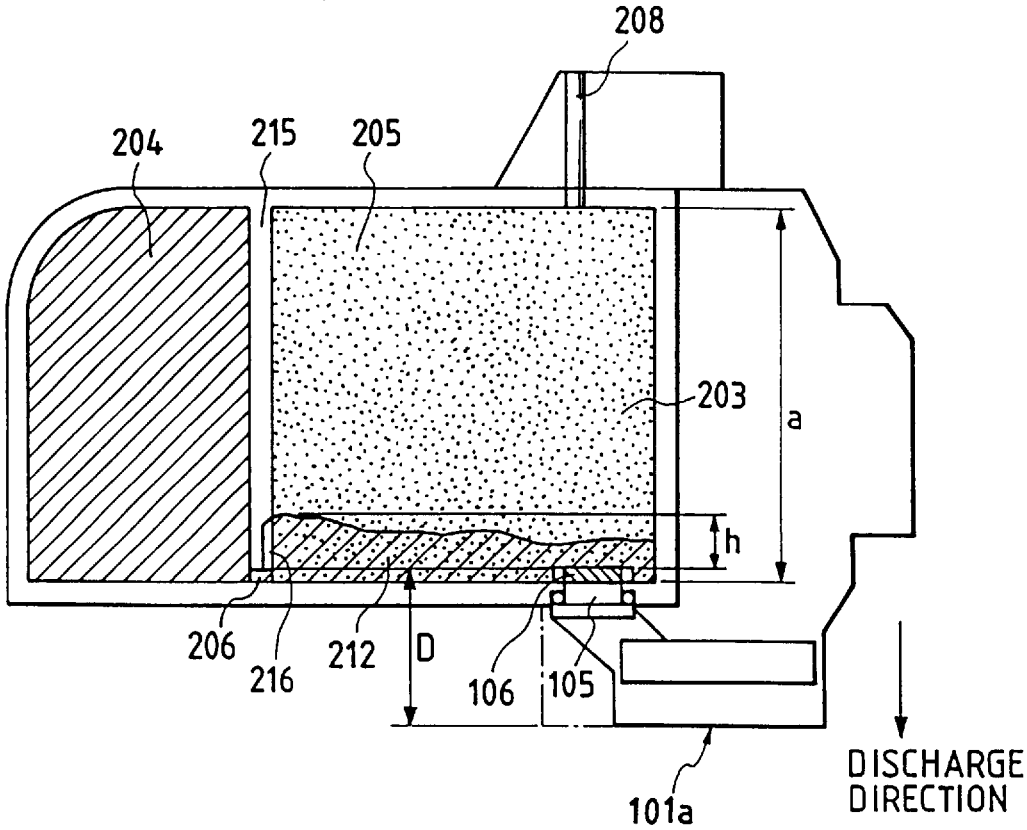
Figure 10B:
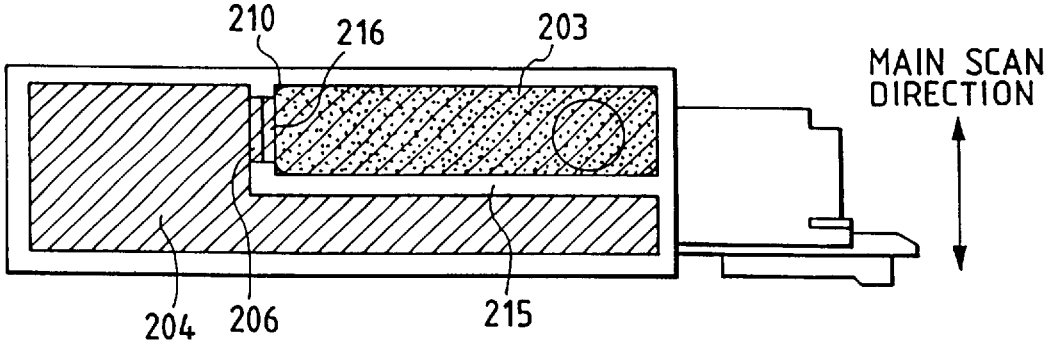

FIGS. 10A and 10B are views best representing the features of an ink jet cartridge according to an embodiment 7. In the figure, like symbols are attached to the elements having the same functions as in the previous embodiment.

FIG. 10A is a cross-sectional view of the inside of an ink tank unit connected to an ink jet head unit, taken along the ink discharge direction. FIG. 10B is a cross-sectional view of the inside of the ink jet cartridge along the main scan direction.

Herein, 105 is an ink communicating member for introducing the ink within the ink jet head unit, and 106 is a filter provided at the end portion of the ink communicating member 105 for preventing the flow of fine dirt particles into the ink jet head.

Figure 11:
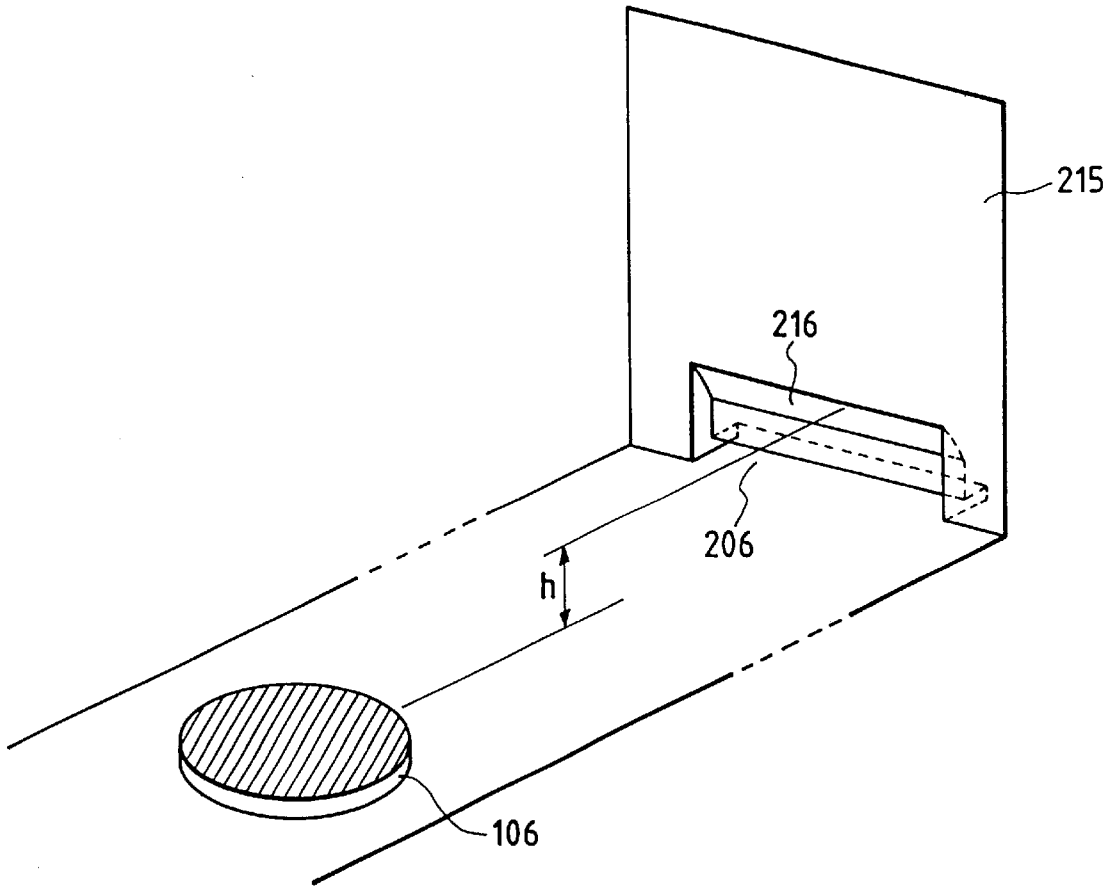
FIG. 11 is a shematic perspective view of a portion of FIGS. 10A and 10B in an enlarged scale.

In FIGS. 10A to 11, a is the height of ink absorbing member receiving portion, and h represents the height of the top of a groove portion with reference to the filter surface disposed at the end portion of the ink communicating member.

This embodiment is different from the embodiment 1 as previously described in that the wide groove portion 216 (concavity) is provided at the upper portion of the ink communicating portion so that the lower portion or one end of the negative pressure generating member receiving portion on a partition wall 215 in the partition portion may be in communication with the ink communicating portion 206. By providing this groove portion 216, the admission passage of the air into the ink storing portion can be easily secured upon the gas-liquid replacement which is made with the ink consumption.

Herein, through the end portion opposite that leading to the ink communicating portion of the groove portion, the gas-liquid replacement is effected. In this embodiment, the groove portion at the end of the gas-liquid replacement side is shallower in depth when leaving father away from the ink communicating portion. Thereby, the introduction of the air into the groove portion is facilitated.

In this embodiment, the negative pressure condition within the negative pressure generating member receiving portion can be determined by the negative pressure generating force (capillary force) of the ink absorbing member 205 which is the negative pressure generating member and the amount of holding the ink within the ink absorbing member 205 residing above the ink supply port portion 209, as shown in FIGS. 8A and 8B.

In this case, the negative pressure generating force within the negative pressure generating member receiving portion is set with a back pressure of DmmAq or greater in a reverse direction to the ink supply direction in the ink supply port, assuming the distance between the ink supply port face and the discharge port face 101*a* of the recording head to be Dmm, in order to prevent the ink leakage through the discharge ports of the recording head.

On the other hand, the upper limit value of negative pressure generating force must be determined in consideration of the ink exhaustion in the ink supply or reduced print density due to insufficient ink supply. In this embodiment, D is equal to 200 mm, and the negative pressure generating force within the negative pressure generating member receiving portion is set in the range from 20 mmAq to 40 mmAq.

As means for controlling the negative pressure within the negative pressure generating member receiving portion, a method of adjusting the height h of the gas-liquid replacement groove portion 216 as previously described is adopted in this embodiment. By changing the height of this groove portion, the position of the gas-liquid boundary face within the negative pressure generating member receiving portion can be adjusted to realize the stability of the negative pressure.

The positional relation between the groove portion and the filter face in this embodiment is such that the distances from the negative pressure generation chamber bottom portion to the filter face of the ink supply port and to the partition wall end portion at the upper portion of the ink communicating portion are identical, as shown in FIGS. 10A and 10B.

The distance h up to the top of the groove portion with reference to the filter face is set at 5 mm, and the gas-liquid interface (ink level) from the ink storing portion to the remaining ink in the absorbing member receiving portion is maintained at a position of about 5 mm or less with reference to the filter face within the absorbing member receiving portion. And by setting the position of the gas-liquid interface to be less than about 5 mm, the negative pressure is generated within the condition range as previously described. Note that the height a of the negative pressure generating member receiving portion is 48 mm in this embodiment.

Accordingly, by adopting the constitution of having a groove portion provided as proposed in this embodiment, the ink supply from the ink storing portion in the ink communicating portion to the negative pressure generating member receiving portion can be stably maintained, and the ink level (gas-liquid interface) within the negative pressure generating member receiving portion can be retained substantially constant. Thereby, the amount of ink received within the negative pressure generating member receiving portion is substantially constant, and the variation in the ink supply or the negative pressure which may have effects on the recording quality can be suppressed.

In this embodiment, as above described, because the filter face of the ink communicating member end portion is projected from the bottom face of the negative pressure generation chamber, the ink absorbing member in the neighborhood of the ink supply port is compressed to concentrate the ink, in order to enhance the ink supply performance to the ink jet head unit.

Note that the height of the groove portion is set above the filter face at minimum, preferably, 1 mm above the filter face, and more preferably 2 mm above.

This is because the uneven distribution of compressing the ink absorbing member may be caused by the condition of insertion of the ink absorbing member, resulting in the possibility that the ink level varies locally within the negative pressure generating member receiving portion, thereby giving rise to ink interruption.

Accordingly, by providing a groove portion as proposed in this embodiment at the upper portion of the ink communicating portion, the ink level within the absorbing member receiving portion in supplying the ink from the ink storing portion to the absorbing member receiving portion is held at an appropriate position, until the ink is used up, so that the static negative pressure within the absorbing member can be generated more stably.

In the embodiment 1 as previously described, there is the possibility that the ink level varies with the ink consumption, as already pointed out. The bottom face of the ink storing portion and that of the absorbing member receiving portion are coplanar, whereby the changes in the ink level will not only give rise to the changes in the negative pressure as previously described, but also possibly disrupt the ink flow passage within the absorbing member, when supplying the ink from the ink storing portion to the absorbing member receiving portion, as with the embodiment 1 in which the ink supply port is provided on the bottom face of the negative pressure generating member receiving portion.

In this case, because such a problem can not be resolved by increasing the gap of the ink communicating portion between both receiving portions as previously described, the following constitution is adopted in the embodiment 8 to realize a further stabilization of the ink supply.

Figure 12A:
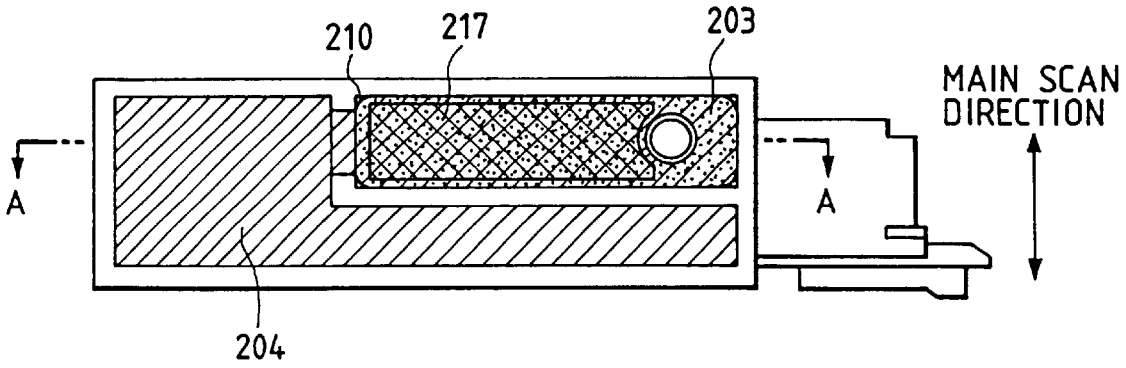
Figure 12B:
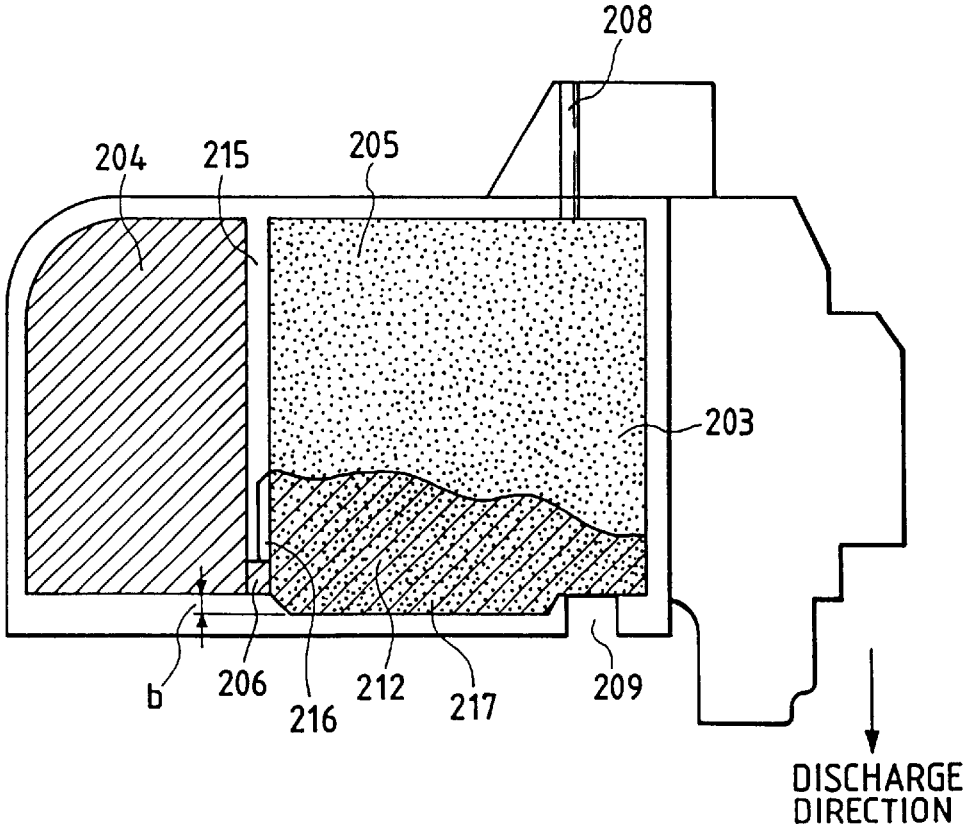

The constitution of this embodiment is shown in FIGS. 12A and 12B. In the figure, like symbols are attached to the elements having the same functions as in the previous embodiment.

FIG. 12A is a cross-sectional view of the inside taken along the ink discharge direction, and FIG. 12B is a cross-sectional view of the inside of an ink jet cartridge taken along the main scan direction.

As shown in FIG. 12B, a recess portion 217 (concave) is provided in the bottom portion of the negative pressure generating member receiving portion, so that the bottom portion of the negative pressure generating member receiving portion is lower than the bottom portion of the negative pressure generating member receiving portion when mounting the ink jet cartridge. This recess portion 217 is provided to have the depth b in the area from the neighborhood of the ink communicating portion 206 to the neighborhood of the ink supply port 209, as shown in FIG. 12A.

By providing this recess portion, the ink flow passage within the negative pressure generating member receiving portion can be secured in the height direction without preventing the formation of meniscus upon the gas-liquid replacement in the ink communicating portion.

Note that the depth b of the recess portion determines the formation width of ink flow passage, greater value of b resulting in more effect, and higher reliability of preventing ink interruption.

The constitution of this embodiment in addition to the constitution of having a groove portion provided on the partition wall as previously described in the embodiment 6 allows more positively the stable generation of the negative pressure, or the securement of ink flow passage, resulting in the stabler ink supply.

Other embodiments which are able to enhance the ink supply performance and the reliability of preventing ink leakage will be described below with reference to the drawings.

Figure 13:
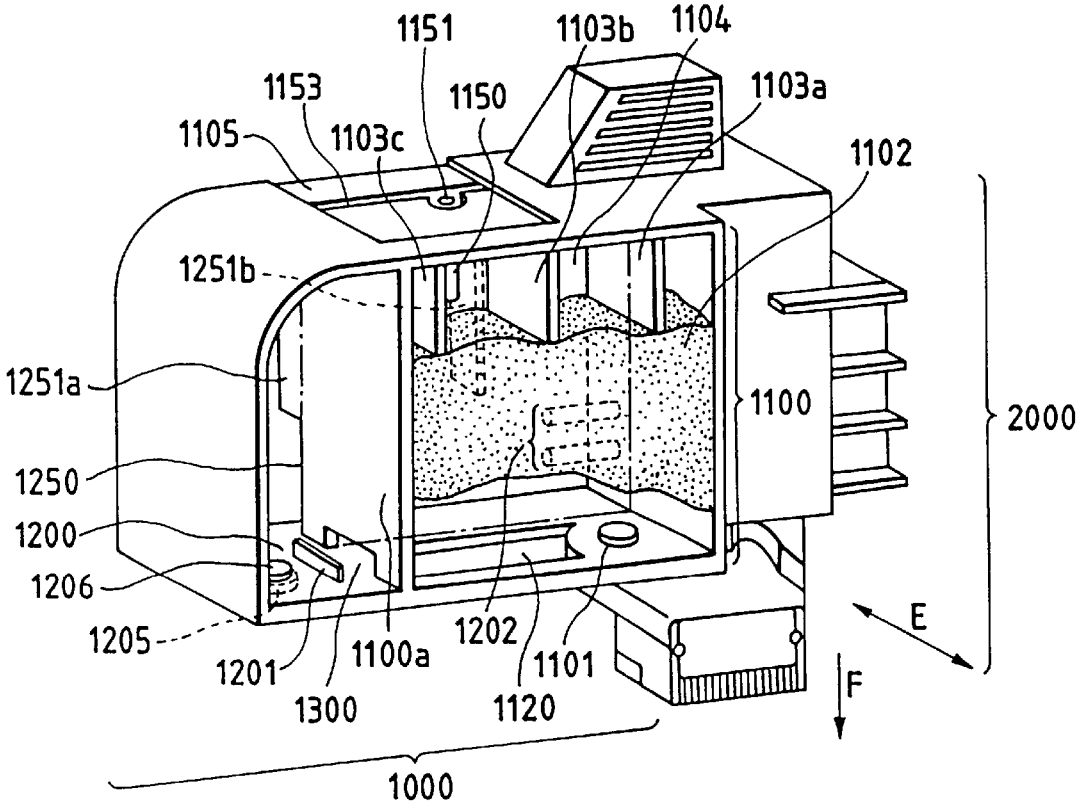
FIG. 13 is a typical perspective view showing another constitution an ink jet cartridge, with a portion in cross section.
Figure 14:
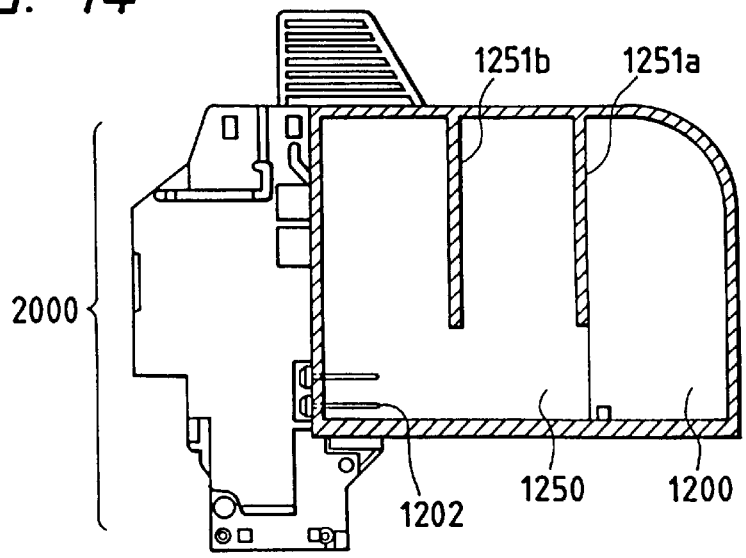
FIG. 14 is a schematic cross-sectional view of the ink jet cartridge as shown in FIG. 13 as looked from the back side.

FIGS. 13 and 14 show one embodiment of the present invention of an ink jet cartridge having a head unit and an ink tank unit connected, wherein FIG. 13 is a typical perspective view showing the constitution of the ink jet cartridge of this embodiment, partly in cross section, and FIG. 14 is a schematic cross-sectional view of the head as shown in FIG. 13 as looked from the back side thereof.

As shown in FIG. 13, an ink tank unit 1000 in this embodiment has a connecting opening portion 1101 as the ink supply port for supplying the ink to an ink jet head unit 2000 as the head portion on the bottom face of the ink tank unit 1000. And the ink tank unit is comprised substantially of a first accommodating chamber 1100 which is a negative pressure generating member receiving portion having an atmosphere communicating portion 1150 for receiving a negative pressure generating member 1102, a posterior second accommodating chamber 1200 for communicating to the bottom face of the first accommodating chamber 1100 through a minute communicating portion 1300 as the ink communicating portion and for storing the ink to be supplied to the first accommodating chamber 1100, and a lateral second accommodating chamber 1250 for communicating at partition walls 1251*a* and 1251*b* having a communicating portion larger than the minute communicating portion 1300 to the posterior second accommodating chamber 1200. In this embodiment, an L-character shaped ink storing portion as in the previously described embodiment is formed by the posterior second accommodating chamber 1200 and the lateral second accommodating chamber 1250.

Herein, the negative pressure generating member 1102 is accommodated in the first accommodating chamber 1100 in two-thirds region from the bottom face of the first accommodating chamber.

The negative pressure generating member stopper ribs 1103*a*, 1103*b* and 1103*c* are disposed at three sites on a ceiling of the first accommodating chamber 1100 so that the volume of not accommodating the negative pressure generating member 1102 can be positively reserved, thereby suppressing excessive insertion of the negative pressure generating member 1102.

With the three stopper ribs as above, the region of the first accommodating chamber formed therebetween consists of an air layer 1104, with the atmosphere communicating portion 1150 disposed in this air layer. Herein, it is important that an opening portion 1152 on the first accommodating chamber side of the atmosphere communicating portion is located at a position spaced a fixed interval apart from the negative pressure generating member 1102 at any time. As a result of examinations, the present inventors have found that in consideration of the fluctuation in inserting the negative pressure generating member 1102, the compressive strain of the stopper ribs 1103, or the softening deformation of the stopper ribs 1103 due to rise in temperature, it is preferred that the above interval is within a range from 3 mm to 5 mm. Herein, the reason for regulating the upper limit is that securing the sufficient distance from the ceiling of the first accomodating chamber to the opening portion 1152 of the first accommodating chamber is important in obtaining safety factor against the ink leakage in the inverted attitude (as will be detailed later). Note that the direction of the arrow E in FIG. 13 points to the scanning direction of the head according to this embodiment, and the direction of the arrow F points to the ink discharge direction from the head.

Figure 15:
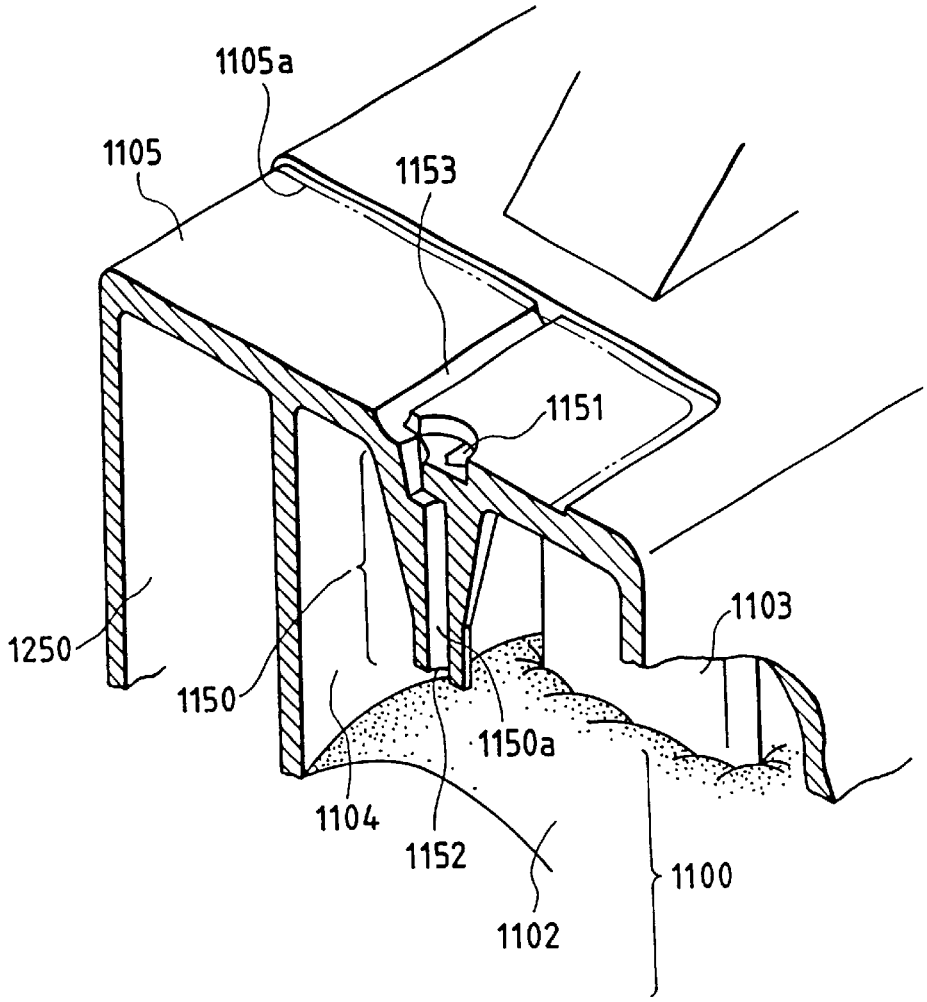
FIG. 15 is an enlarged perspective view showing the constitution around the periphery of an atmosphere communicating portion in an ink tank unit of the ink jet cartridge as shown in FIGS. 13 and 14, with a portion in cross section.
Figure 16:
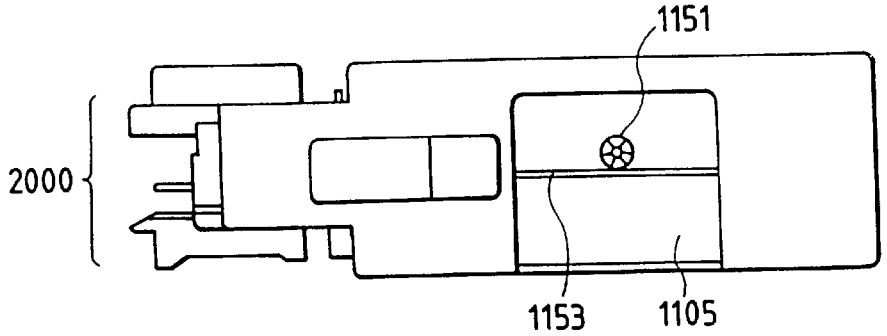
FIG. 16 is a plan view showing the constitution of an opening face of the atmosphere communicating portion as shown in FIG. 15.

FIG. 15 is an enlarged cross-sectional perspective view of the atmosphere communicating portion and its surrounding in this embodiment. FIG. 15 is a view of an opening portion 1151 of the atmosphere communicating port as shown in FIG. 13, as looked from the above. The atmosphere communicating portion 1150 is substantially comprised of a barrel portion 1150*a* extending from the inside of the first accommodating chamber 1100 to its wall portion and deadlocked near the outer face of the wall portion, as shown in FIG. 15, and an opening portion (opening portion 1151 of the atmosphere communicating port) divided into plural (three in this embodiment) branches from the deadlock portion of the barrel portion 1150*a*. This opening portion is provided on the outer surface of a housing for the ink tank unit 1000. Note that the opposite end to the opening portion 1151 of the atmosphere communicating port of the barrel portion 1150*a* corresponds to the opening portion 1152 of the first accommodating chamber. And this atmosphere communicating portion 1150 is a hole for introducing the outside air into the ink tank unit 1000 to obtain a pressure equivalent to the external pressure during the printing, but considering the vaporization of the ink, it is preferred to be slender and long. However, such a shape was contrary to its function from the respects of the process maintenance of the mold and the modling cycle in injection molding the vessel in plastic in the manufacturing process of the ink tank unit 1000. As a result, the evaporation of the ink may be permitted to some extent, or the part around the atmosphere communicating portion constituted of a plurality of members to attain its goal. The former has a problem, particularly in the color recording head, that the color tint may change between the initial time of the use and its terminal time, while the latter brings about the increased number of processes because of the complex manufacturing process with the increased number of parts, resulting in expensive recording head.

For the above problem, the present inventors have proposed a construction of holding a slender pin of the mold not to be swung in injection molding a slender and long atmosphere communicating port, as well as effecting the integration (integral molding) of complex shaped parts and preventing the foreign matter from directly entering the inside of the tank vessel through the opening portion of the atmosphere communicating portion disposed on the surface of the product.

Figure 17A:
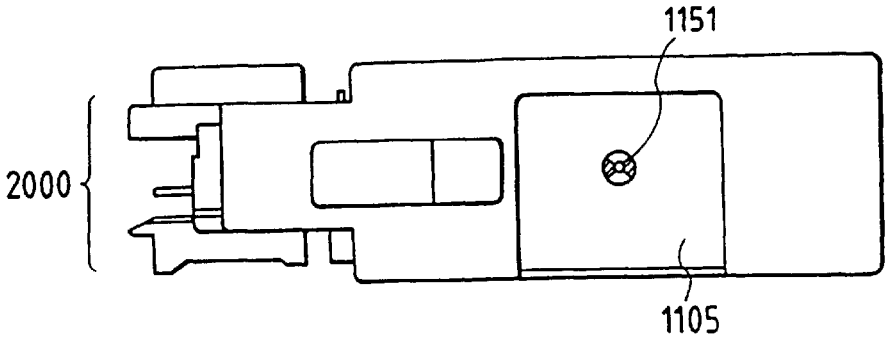
FIGS. 17A to 17C are plan views showing the opening profile of another atmosphere communicating portion according to the present invention.
Figure 17B:
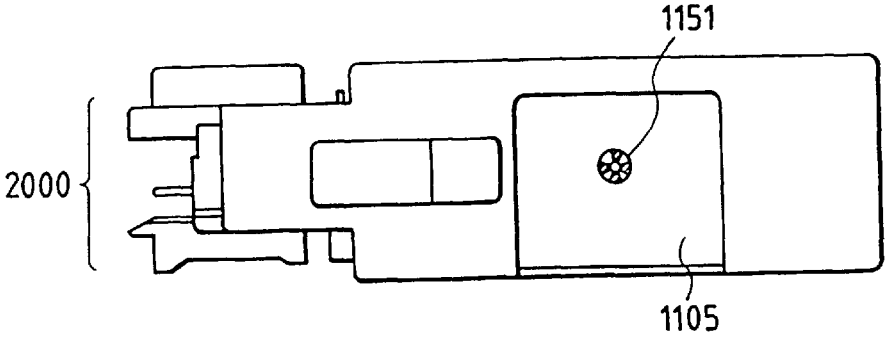
Figure 17C:
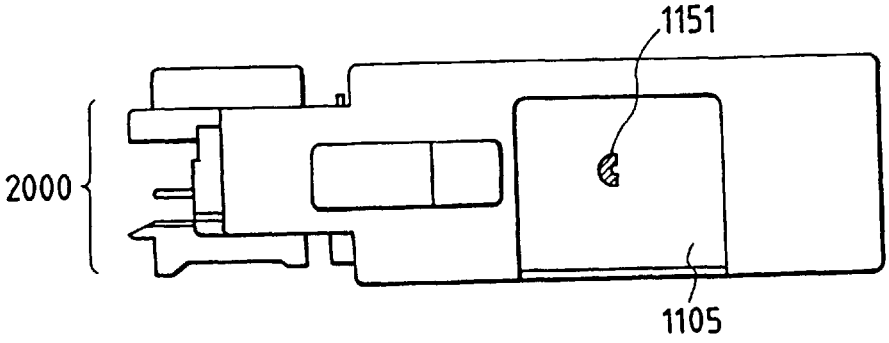
Figure 17D:
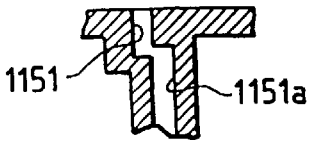
FIG. 17D is a cross-sectional view showing the internal structure of the atmosphere communicating portion of FIG. 17C.

In FIG. 15, the opening portion 1151 of the atmosphere communicating port is configured to accept the pin on the slide side with three claws provided on the fixed side CAV (cavity) of the mold, whereby the splender pin can be positioned and molded at high precision. In this embodiment, the atmosphere communicating port having an inner diameter ø of 1.0 mm and a length of 10 mm can be fabricated in about 20 seconds in the typical molding cycle. In this embodiment, the opening portion 1151 of the atmosphere communicating port is divided into three sections, but not limited to three, the opening portion may be divided into two or four sections with two or four claws (see FIGS. 17A and 17B). From the positional relation between the gate position and the atmosphere communicating portion, a through hole like a crank may be molded by providing a claw at one site on the side of keeping the slide pin from inclination due to the pressure of flowing resin (see FIG. 17C). It goes without saying that the ink jet cartridge in the previous embodiment may be used, but not limited to the tank unit in this embodiment, and is also effective in an integral or replacement-type tank vessel in which the negative pressure generating member is received substantially entirely within the ink storing portion.

Then, the surface of the opening portion 1151 of the atmosphere communicating port opens into a groove 1153 depressed 1 mm below a label pasting flank 1105 constituting a part of the outer surface of the ink tank unit 1000 which is 0.2 mm or more below the surface of the tank vessel, this groove 1153 being covered with a plastic film 1105*a* (e.g., a label) shown in dot-dash lines, having a adhesive layer, and the port communicating to the atmosphere through the groove extended beyond the film.

The groove 1153 is formed in greater length than the film width on both sides of the film. When the film is pasted at the normal position, two opening portions to the atmosphere are provided on the both sides of the film. And even if the film is deviated to either one side, one opening portion to the atmosphere can be secured at any time. One aim of covering the opening portion 1151 of the atmosphere communicating portion with the film is mostly the appearance, but the other aim is to secure the total extension of the atmosphere communicating port and suppress the evaporation. The plastic film may be a laminate of synthetic paper UPO and polypropylene film, or a film having a print layer inserted between former two layers and an adhesive layer applied.

Figure 18:
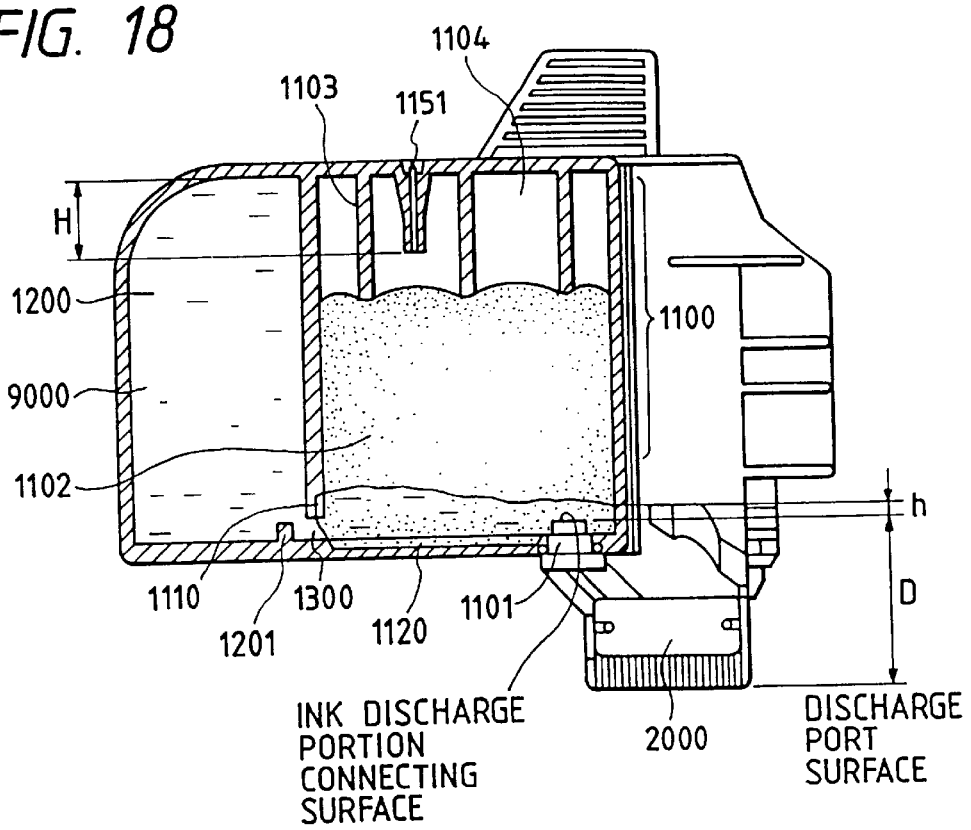
FIG. 18 is a cross-sectional view showing the internal structure of a first accommodating chamber of the ink tank unit in the ink jet cartridge as shown in FIGS. 13 to 16.
Figure 19:
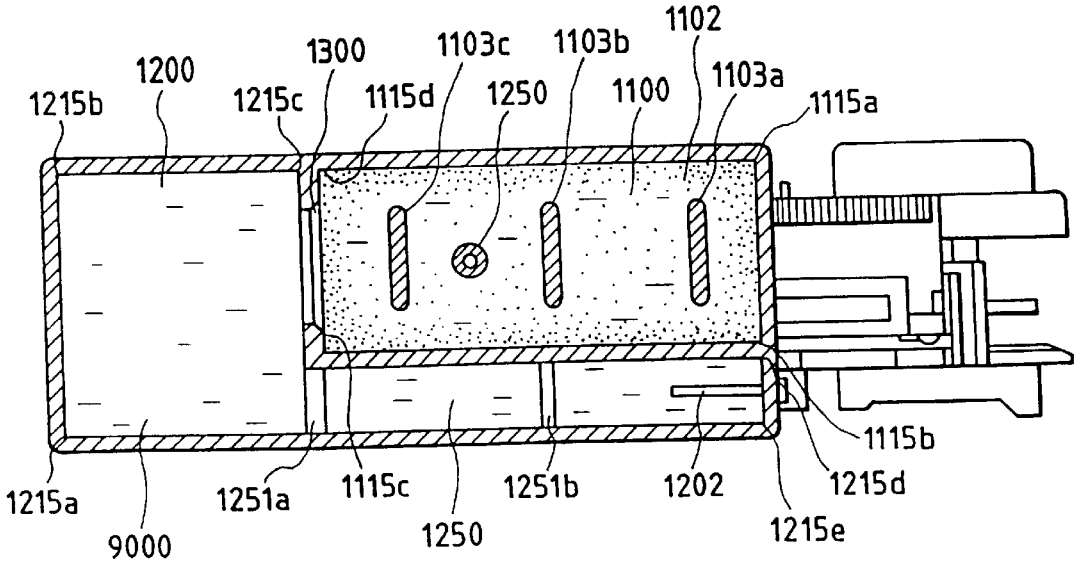
FIG. 19 is a cross-sectional view of the ink tank portion as shown in FIG. 18 as looked from the bottom side.

Referring now to FIG. 18, the generation of negative pressure in the ink tank unit of this embodiment will be described.

The condition of the negative pressure in the first accommodating chamber 1100 is determined by the negative pressure generating force of the negative pressure generating member 1102 and the holding amount of the ink within the negative pressure generating member 1102 provided above the connecting face of the ink discharge portion, as previously described. Also, the negative pressure within the first accommodating chamber 1100 must be −D mmAq or greater, assuming the distance between the connecting face of the ink discharge portion and the head discharge port face to be D mm, taking into consideration the ink leakage through the head discharge ports.

Also, the upper limit of the negative pressure must be determined by taking into consideration the ink exhaustion in the ink supply, the reduced print density in the insufficient supply, and the disorder in the image. In this embodiment, D is equal to 20 mm, and the negative pressure of the negative pressure generating member 1102 is set within the range from −20 mmAq to −40 mmAq.

As one means for controlling the negative pressure of the first accommodating chamber 1100, there is a way of adjusting the height h of a gas-liquid replacement promoting structure 1110 having a construction in which on the wall surface on the first accommodating chamber 1100 of the partition wall 1100*a* for partitioning between the first accommodating chamber 1100 and the second accommodating chamber 1200, the upper portion of the minute communicating portion 1300 is formed thin, or a construction containing a groove provided on the wall surface of the partition wall 1100*a* as previously described. By using this structure, the air moves from the first accommodating chamber 1100 to the posterior second accommodating chamber 1200 in the closed state, while at the same time the ink is supplied from the second accommodating chamber to the negative pressure generating member 1102 within the first accommodating chamber 1100 so that the ink liquid level can be maintained below the top of the gas-liquid replacement promoting structure 1110. Accordingly, by changing the top portion of this gas-liquid replacement promoting structure 1110, the gas-liquid boundary surface within the first accommodating chamber 1100 can be set at any level.

In this embodiment, assuming the height h from the connecting surface of the ink discharge portion to the top portion of the gas-liquid replacement promoting structure to be 5 mm, the ink liquid level in the gas-liquid replacement during the recording and non-recording (including standby) is always maintained,in the range from 2 mm to 5 mm above the connecting surface of the ink discharge portion, whereby the stable state can be established until all the ink within the posterior second accommodating chamber 1200 and the lateral second accommodating chamber 1250 is used up.

In this embodiment, on the bottom face of the first accommodating chamber 1100 is provided an ink supply promoting structure 1120 having a portion slightly lower than its bottom face. The structure of this ink supply promoting structure 1120 will be detailed later. This structure is disposed for the purpose of eliminating the interruption of the ink from the minute communicating portion 1300 to the connecting surface of the ink discharge portion, but becomes extremely effective means when the proper negative pressure can not be obtained only by the adjustment of the height of the gas-liquid replacement promoting structure 1110. For example, this is effective when the connecting opening portion 1101 with the ink jet head unit 2000 is on the bottom face of the ink tank portion 1100, or when the distance from the minute communicating portion 1300 to the connecting opening portion 1101 is large, or both as in this embodiment shown in FIGS. 2A and 2B.

In this embodiment, the depth of the ink supply promoting structure 1120 is 1.5 mm lower than the bottom surface of the posterior second accommodating chamber 1200 and the lateral second accommodating chamber 1250, or the bottom surface of the minute communicating portion 1300, thereby resolving all the previous problems.

The ink supply promoting structure 1120 in this embodiment has an evenly lower bottom surface, but may have several slits of equivalent depth disposed. Also, in the ink tank unit of a structure wherein the connecting opening portion 1101 is opposed to the partition wall 1100*a* having the minute communicating portion 1300, it has been confirmed that the same effects can be obtained by disposing a projection-like rib.

Referring now to FIGS. 19 to 21C, the ink leakage through the atmosphere communicating port of the ink tank unit will be described below.

The ink jet cartridge of the constitution of this embodiment can prevent evaporation during physical distribution, and is placed in such a packaged state that the head is not damaged and the function is not impaired.

Meanwhile, the discharge port face most governing the head characteristics is covered with a protecting seal tape, but the opening portion of the atmosphere communicating portion leading to the inside of the ink jet cartridge is not sealed. In the case of a replacement-type ink cartridge, there are only provided the connecting opening portion to the head portion and the atmosphere communicating port, wherein these two opening portions may be sealed with a seal tape.

However, in the case of an integral-type head, when all the opening portions are closed to prevent ink leakage, the increased internal pressure caused by environmental changes may produce ink leakage through the opening portion and the connecting portion between the discharge portion and the tank portion.

Also, the ink discharge port can not be completely sealed by a seal tape owing to pits in the structure. For such reasons, in the integral-type ink jet cartridge, the atmosphere communicating port is opened within the physical distribution package.

Therefore, in the ink tank unit having the first and second accommodating chambers, if the head cartridge is physically distributed in the device attitude, the atmosphere communicating port is located upward, without ink leakage, but in other attitude, particularly in the inverted attitude, the ink in the second accommodating chamber may flow into the air layer 1104, sometimes leakage through the atmosphere communicating port and splashing into the package.

In this embodiment, as means of preventing ink leakage within the ink tank unit through the atmosphere communicating portion in all the attitudes of physical distribution as above described and under the environmental temperature or humidity condition or both complicated condition, four vertical edge line portions 1115*a*, 1115*b*, 1115*c* and 1115*d* contacted by the negative pressure generating member 1102 of the first accommodating chamber 1100 are curved with a radius of curvature of 2 mm, so that the negative pressure generating member 1102 can evenly press on the absorbing member at four corners not to cause exfoliation or distortion to produce interstice and cause the inflow or concentration of the ink at the corner portion.

On the other hand, five vertical edge line portions 1215*a*, 1215*b*, 1215*c*, 1215*d* and 1215*e* of the posterior second accommodating chamber 1200 and the lateral second accommodating chamber 1250 except for the minute communicating portion 1300 are curved with a radius of curvature of 2 mm, and a projection 1201 having a height of 2 mm and a width of 14 mm is disposed in the neighborhood of the minute communicating portion 1300 on the bottom surface of the posterior second accommodating chamber 1200. The necessity for providing curvature for each of the edge line portions of two second accommodating chambers and the projection on the bottom surface as above described is based on the following experimental results conducted by the present inventors.

Figure 21A:
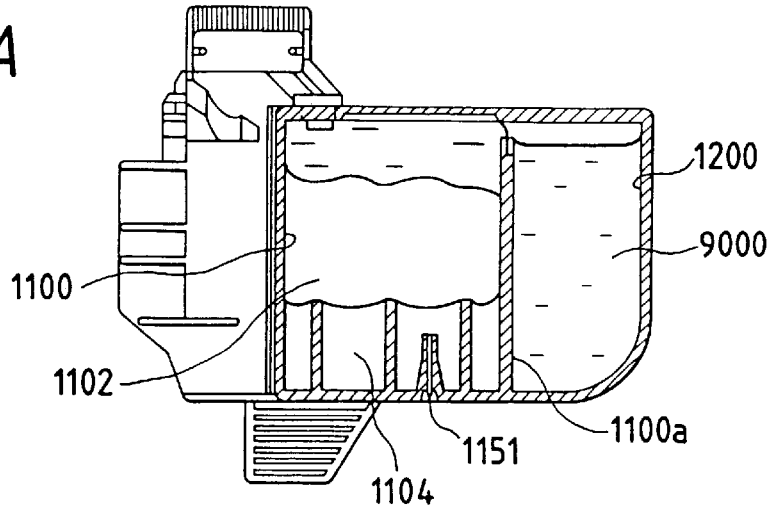
FIGS. 21A to 21C are cross-sectional views for explaining the mechanism of the ink movement within the ink tank unit without a bottom projection 1201.
Figure 21B:
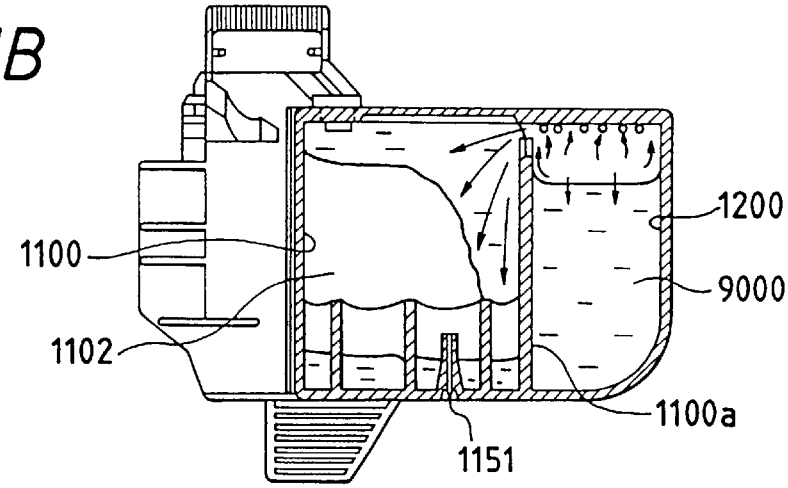
Figure 21C:
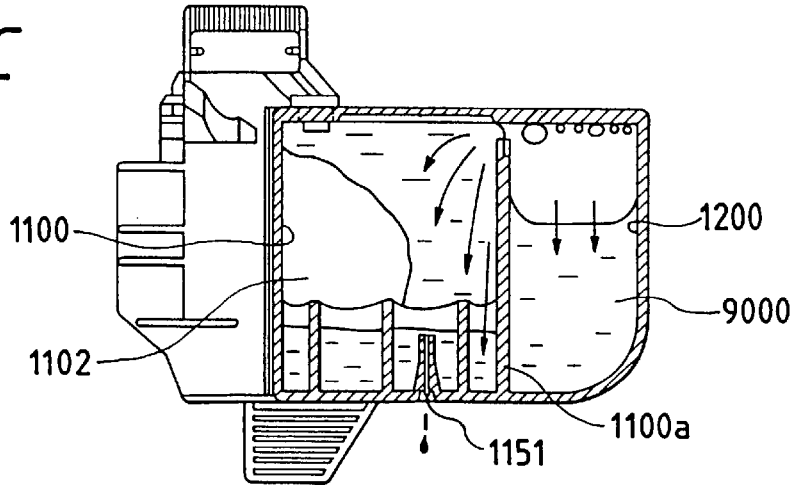

FIGS. 21A to 21C are cross-sectional views of an ink jet cartridge without vertical edge line portion 1215*a* to 1215*e* and the bottom projection 1201 in the two second accommodating chambers 1200 and 1250. If the ink jet cartridge is placed in the inverted state with the discharge port face upward, and under the physical distribution environment of high temperatures (60° C. to 80° C.), the ink filled within the second accommodating chamber thermally will expand and permeate through the minute communicating portion 1300 into the negative pressure generating member 1102. At this time, the internal pressure is released through the atmosphere communicating port. Then, the gas-liquid replacement occurs through the atmosphere communicating port and the minute communicating portion 1300, so that the air is filled in the second accommodating chamber 1250 (see FIG. 21A).

Further, the gas-liquid replacement between the ink within the second accommodating chamber and the air within the first accommodating chamber 1200 occurs even if the ink liquid level falls below the height of the minute communicating portion 1300 of the partition wall 1100*a*. This is due to the fact that the edge portions of five vertical edge lines orthogonal to the bottom surface (upper surface in this figure) within the second accommodating chamber 1250 pull up the ink owing to capillary force, and the expanded air within the second accommodating chamber 1250 promotes it (see FIG. 21B).

Further, the air layer within the second accommodating chamber 1250 contains the evaporation of the water content in the ink, causing a phenomenon in which the water vapor in the supersaturated state is bedewed on the bottom surface of the second accommodating chamber (upper face in this figure). In particular, if there is a temperature variation, this state will occur more remarkably. As a result, dewed water droplets are gradually accumulated to become larger water droplets, some part of which will drip into the ink, other part being sucked through the minute communicating portion into the negative pressure generating member 1102. Because of this and the pulling up of the ink in the edge line portions as above described due to capillary force, the ink moved into the first accommodating chamber is reserved in the air layer 1104, and begins to leak through the atmosphere communicating port to the outside when the ink liquid level exceeds the height of the atmosphere communicating portion (see FIG. 21C).

Figure 20A:
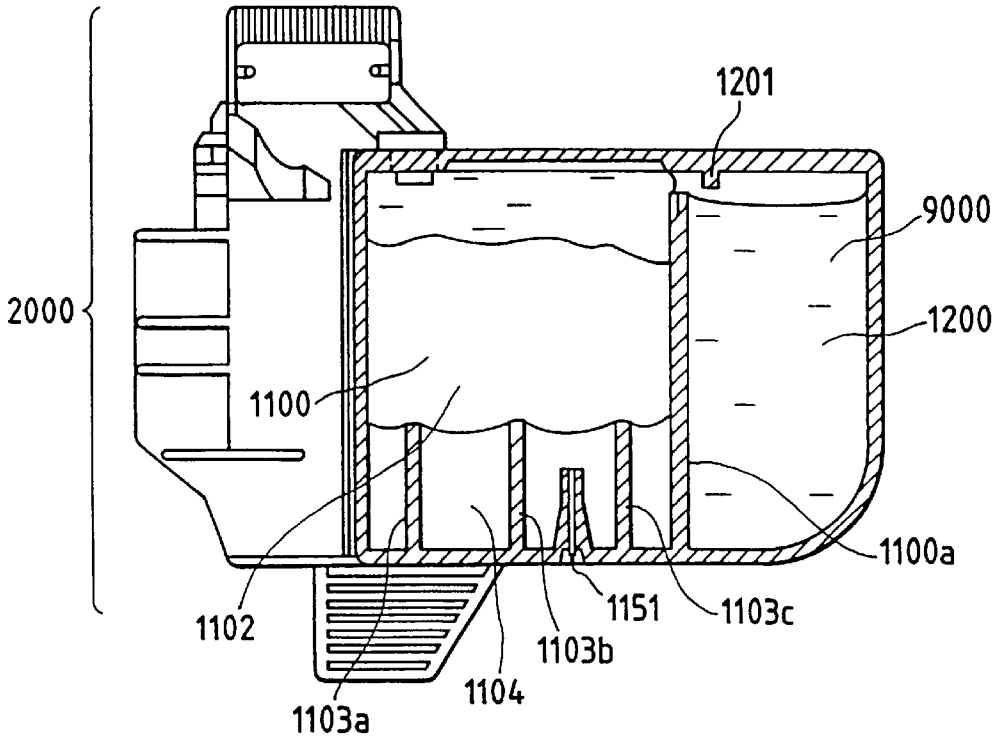
FIGS. 20A and 20B are cross-sectional views for explaining the ink movement within the ink tank portion as shown in FIG. 19, respectively.
Figure 20B:
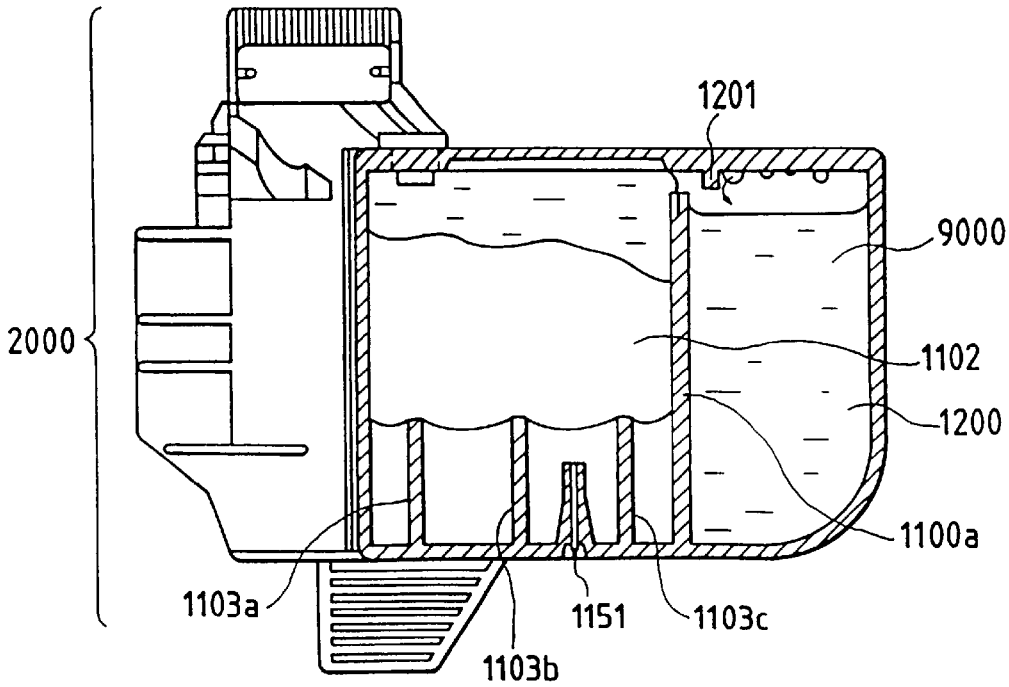

On the contrary, FIGS. 20A and 20B are cross-sectional views of an ink jet cartridge according to this embodiment in which five vertical edge line portions orthogonal to the bottom surface of the second accommodating chamber are curved, and a projection 1201 is disposed in the neighborhood of the minute communicating portion 1300. With the discharge port face upward.

In FIGS. 20A and 20B, if exposed to high temperature environment at the initial stage, the ink will expand in volume to permeate into the negative pressure generating member 1102. Because of this and the gas-liquid replacement, the ink in the amount corresponding to the height of the minute communicating portion 1300 is moved from the second accommodating chamber 1200 to the first accommodating chamber 1100 (see FIG. 20A).

However, because the vertical edge line portions of the second accommodating chamber 1200 are curved, there is no capillary force exerted on the ink, causing no movement of the ink still in the initial state.

Also, water droplets bedewed to the bottom surface (upper surface in this figure) of the second accommodating chamber 1200 are blocked by the projection 1201 provided near the minute communicating portion 1300, but not absorbed by the negative pressure generating member 1102, and will drip into the ink within the second accommodating chamber 1200. Accordingly, the ink is not moved beyond a certain amount, thereby preventing ink leakage through the atmosphere communicating port (see FIG. 20B).

Herein, the height H of the connecting portion in the atmosphere communicating port (see FIG. 18) is necessary to be high enough that when the ink flows into the air layer 1104, the ink may not flow into the opening portion in the first accommodating chamber of the atmosphere communicating port. In this embodiment, H=10 mm was obtained by multiplying the ink liquid level corresponding to the maximum flowable amount of the ink of the second accommodating chamber 1200 in the inverted state, by a safety factor of two.

Referring now to FIG. 22 and FIGS. 23A to 23D, a manufacturing process of the ink tank unit in this embodiment will be described below.

Figure 22:
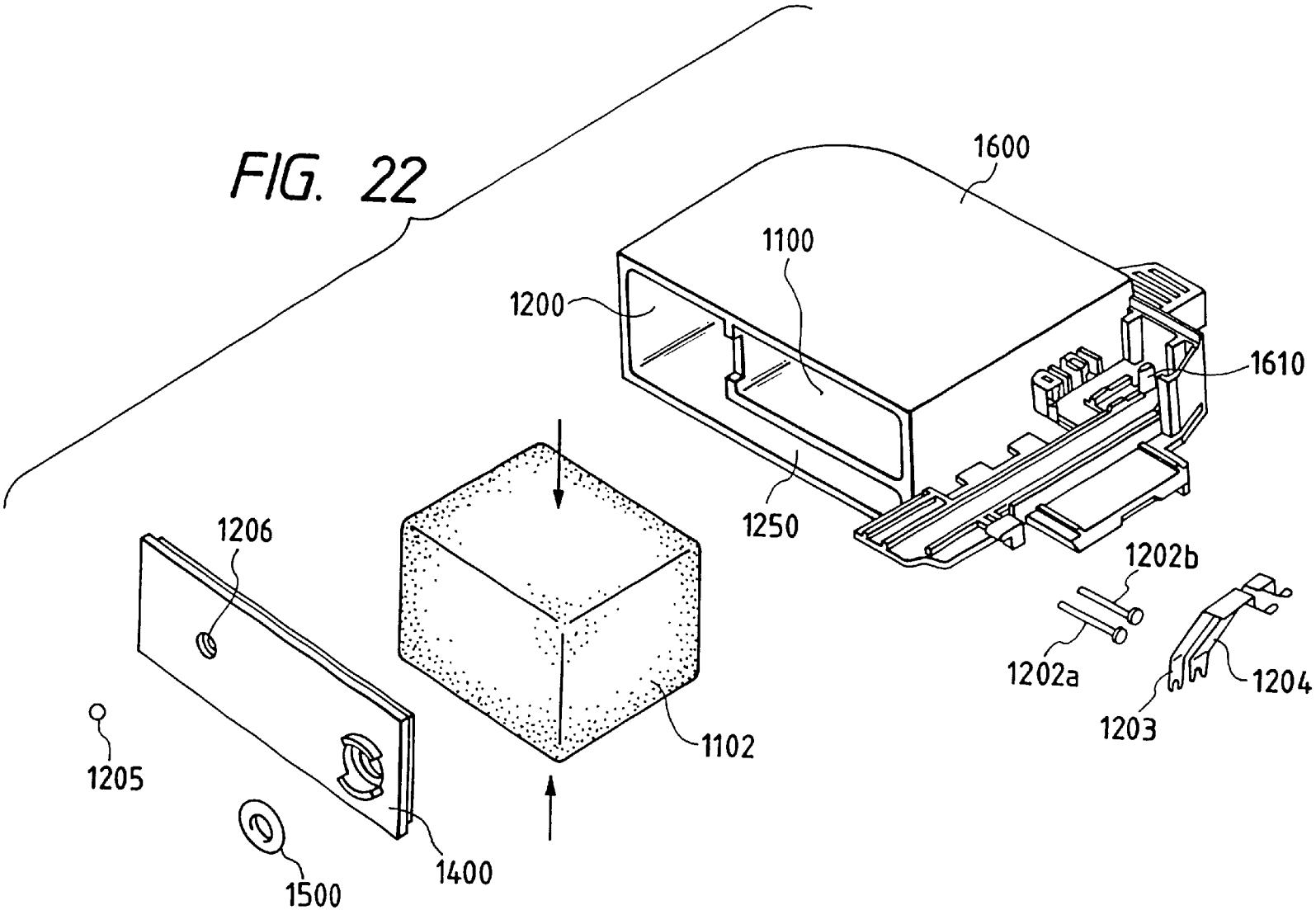
FIG. 22 is an exploded perspective view showing the constitution of the ink jet cartridge, particularly the ink tank unit as shown in FIGS. 13 to 16.

In FIG. 22, 1600 is an ink tank unit housing, 1102 is a negative pressure generating member, and 1400 is a vessel lid. 1202*a* and 1202*b* are electrode pins for sensing the remaining amount of ink, and 1203 and 1204 are contact members extending from each electrode pin to electrode disposed in the ink discharge portion. 1206 is an ink pouring port, and 1205 is an ink pouring port plug. The ink tank unit housing 1600 is formed by integral molding of resin. Within the first accommodating chamber 1100 of the ink tank unit housing 1600 is accommodated a negative pressure generating member 1102, which is inserted after compressed from both sides in the direction of the arrow of FIGS. 21A to 21C. The negative pressure generating member 1102 is compressed to one-third to one-fourth the volume when accommodating it.

Thereafter, the vessel lid 1400 is joined with the ink tank unit housing 1600, but this connection is effected by welding from the respects of the air-tightness in the junction and the productivity. Especially, the ultrasonic welding is preferable means from the aspects of both the reliability and the productivity. Thereafter, the electrode pins 1202*a* and 1202*b* are forced via the contact members 1203 and 1204 into the neighborhood of the bottom face of the lateral second accommodating chamber 1250 of the tank housing 1600, and welded thereto.

Figure 23A:
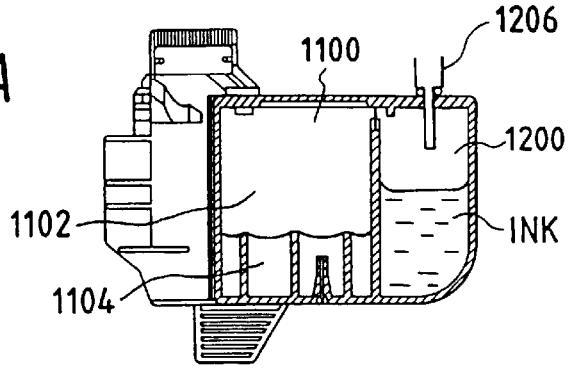
FIGS. 23A to 23D are cross-sectional views for sequentially explaining the ink pouring process into the ink tank unit of the ink jet cartridge as shown in FIGS. 13 to 16.
Figure 23B:
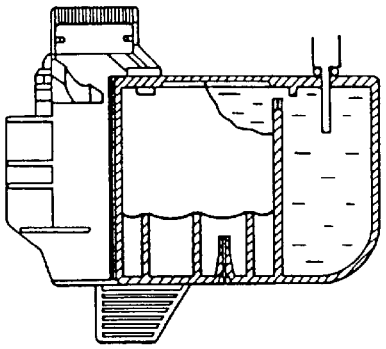
Figure 23C:
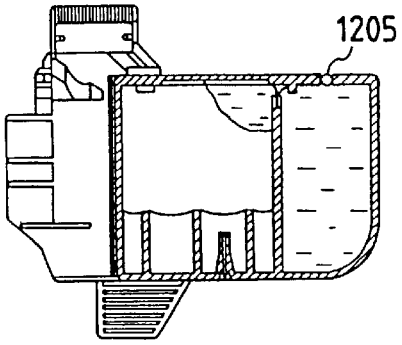
Figure 23D:
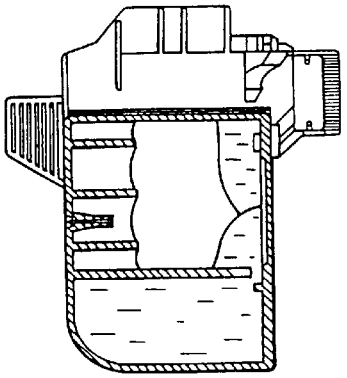

The ink is poured into the ink tank unit 1000 thus assembled through the ink pouring port 1206 opened in the vessel lid 1400. The pouring process is shown in FIGS. 23A to 23D. In pouring the ink, the ink is poured under pressure by a fixed amount in the inverted attitude where the minute communicating portion is placed on the uppermost portion, with an inner diameter ø of the ink supply port of 1.5 mm and at a pouring speed of about 4 cc/sec as shown in FIG. 23A, whereby the excellent pouring conditions without bubbling can be obtained. The pouring of the ink is stopped at the time when the second accommodating chamber is filled with the ink to cause the ink to flow from the minute communicating portion into the negative pressure generating member, and the supply port portion is pulled out at the top end and plugged substantially at the same time (primary pouring) (FIGS. 23B and 23C). Thereafter, by adopting an attitude with the opening of the ink discharge portion placed at the uppermost position (FIG. 23D) the ink is poured under pressure by a fixed amount, whereby the pouring is completed (secondary pouring).

This secondary pouring is made through a nozzle of ø 1.5 mm and at a pouring rate of about 4 cc/sec by inserting it to the extent that the supply port touches the negative pressure generating member 1102, like the primary pouring, so that the ink is dispersed evenly.

Finally, a label is pasted on the outer surface of the tank, thereby completing the ink tank unit.

Next, the ink jet unit and its assembling method will be described.

Figure 24:
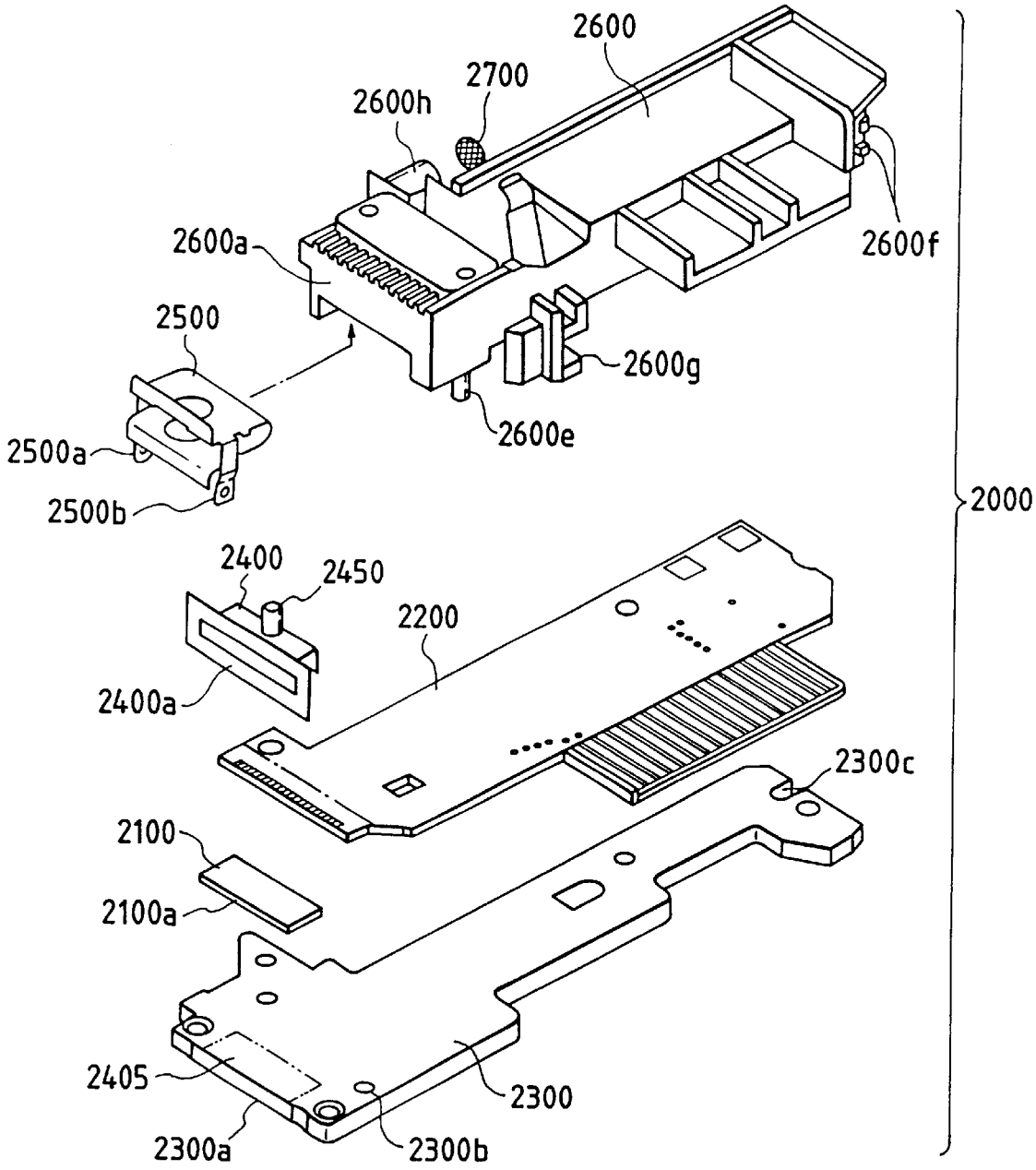
FIG. 24 is an exploded perspective view showing the constitution of the ink jet cartridge as shown in FIGS. 13 to 16, particularly the ink jet head unit as the head portion.

FIG. 24 is an exploded perspective view showing a constitution of an ink jet unit 2000 in this embodiment. Herein, 2100 is a substrate (heater board) with elements (heaters) arranged for generating the heat energy which is ink discharge energy, and 2400 is a ceiling plate (grooved ceiling plate) having grooves for forming liquid flow passages corresponding to elements as well as having a member with the ink discharge ports formed corresponding to liquid flow passages. 2200 is a circuit substrate for supplying electric power to a heater board 2100, 2300 is a base plate serving as the reference in packaging the ink discharge portion, 2500 is a presser spring for applying even pressure (line pressure) near the discharge ports of the discharge portion by forcing the ceiling plate 2400 and the heater board 2100 into intimate contact with each other.

2600 is a holder having inside a flow passage for supplying the ink from the ink tank unit to the ink jet head unit, wherein a filter 2700 for preventing the invasion of foreign matter is welded on the connecting surface with the ink tank of the ink communicating portion 2600 of the holder.

Figure 25:
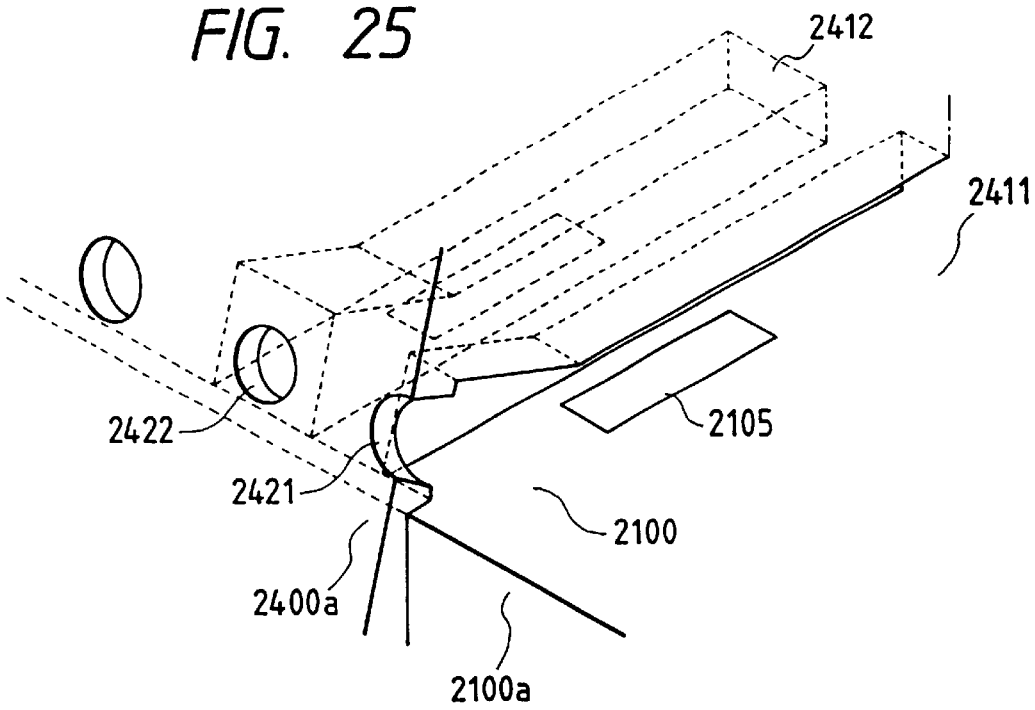
FIG. 25 is a typical perspective view for explaining the periphery of the ink discharge port of the ink jet head as shown in FIG. 24 in an enlarged scale.

In FIG. 24, an adhesive is applied a predetermined thickness in a predetermined region 2405 near the front end face 2300*a* on the surface of a support 2300, on the applied surface of which a heater board 2100 is secured by adhesive so that its front end face 2100*a* and a front end face 2300*a* of the support 2300 are flush. The ceiling plate 2400 is disposed on this heater board 2100 by temporarily joining so that an orifice plate 2400*a* is disposed in front of both front end faces 2100*a* and 2300*a* of the heater board 2100 and the support 2300, as shown in FIG. 14. Herein, in FIG. 25, 2105 is a discharge heater as electrothermal converter provided at a predetermined position on the heater board 2100. Also, 2411 and 2412 are ink flow passage grooves formed on the ceiling plate 2400, and 2421 and 2422 are discharge ports bored by excimer laser on the orifice plate 2400*a* of the ceiling plate 2400.

Figure 26:
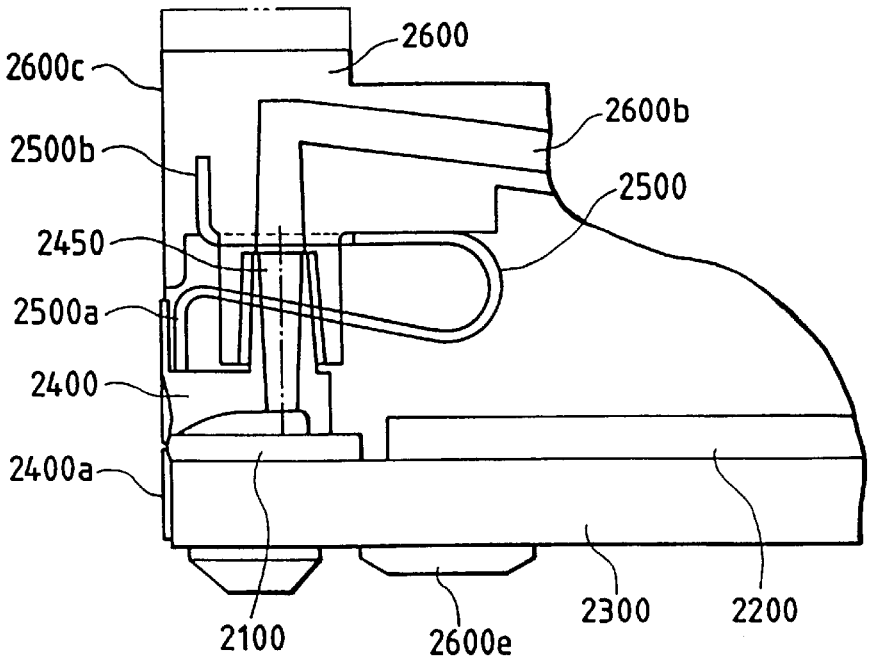
FIG. 26 is a lateral cross-sectional view for explaining the top end of the ink jet head unit as shown in FIG. 24 in an enlarged scale.

In this way, with the ceiling plate 2400 temporarily joined on the heater board 2100, the heater board 2100 and the ceiling plate 2400 are on the support 2300, as shown in FIG. 26, and further a holder 2600 covering and protecting the wiring substrate 2200 is placed thereon.

An assembling method of an ink jet head unit of the present invention will be described below.

After the heater board 2100 is bonded by an adhesive (silicon-type adhesive SE4400: made by Toray) 10 to 30 μm thick on the support 2300, the connection with the wiring substrate 2200 is made by wire bonding with aluminum wire. The ink discharge ports of the ceiling plate 2400 and the discharge heaters 2105 of the heater board are aligned with each other and then temporarily secured by applying a ultraviolet curable adhesive (TB3006B: made of Three Bond) to both end portions of the ceiling plate 2400. Then, for the junction between the ceiling plate 2400 and the heater board 2100, a spring 2500 for concentratively pressing on the discharge ports and the neighborhood of the liquid flow passage is settled. The spring 2500 has spring legs 2500*a*, 2500*b* on both sides, and secured by engagement with the heater board 2100. Then, the ceiling plate 2400 is put on the heater boards 2100, 2200, and the support 2300. The holder 2600 has a pair of leg portions 2600*e* disposed on both sides of the ceiling plate 2400, which are inserted through a pair of holes 2300*b* in the support 2300 to project the top ends of the leg portions 2400*e* beyond the back face side of the support 2300.

Finally, a silicon sealing agent (TSE399BC Toshiba Silicon) is poured from the upper portion of the holder to the gap between the holder 2600 and the ceiling plate 2400 or the base plate 2300, the gap between the ceiling plate 2400 and the heater board 2100, the gap between the orifice plate 2400*a* and the heater board end portion 2100*a* or the base plate end portion 2300*a*, for the protection of the wire bonding portion.

Next, the mounting of the ink jet head unit 2000 on to the ink tank unit 1000 will be described below. In FIGS. 22 and 24, 1610 and 2600*f* are a projection and a latch having spring property attached to the ink tank unit housing 1600 and the holder 2600, whereby the falling of the ink jet head unit can be prevented by engagement of both.

On the other hand, the connecting opening portion 1101 of the ink jet head unit in the ink tank unit 1000 is joined via an O-ring 1500 to the ink tank connecting portion 2600*h* of the ink head unit to prevent ink leakage.

In the above way, the ink jet cartridge is completed.

Figure 27:
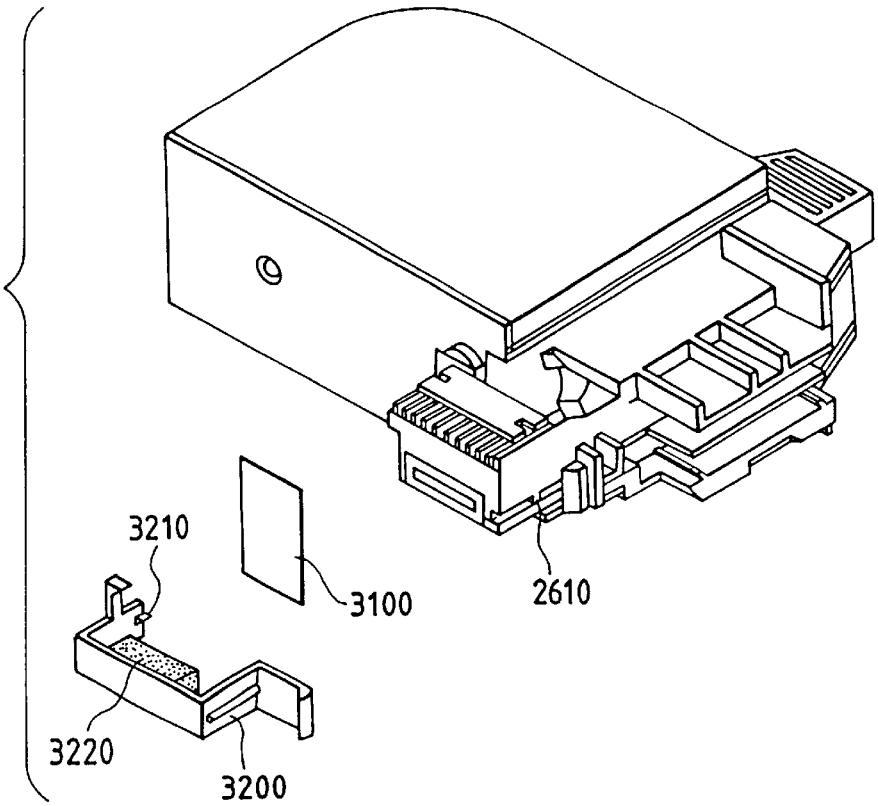
FIG. 27 is a perspective view for explaining the protection of the top end of the discharge port portion of the ink jet head unit in the ink jet cartridge as shown in FIGS. 13 to 16.

Then, the packaging of the ink jet cartridge will be described below. FIG. 27 shows the assembling of a protective tape 3100 and a protection cap 3200 for protecting the discharge ports from drying and fixing or damage during physical distribution in packaging. The protection cap 3200 has a sponge 3220 in an area in contact with the discharge port face via the protective tape 3100, the protective tape 3100 being forced into contact with the discharge port face by a pressing force of 500 to 2000 g of this sponge.

The protection cap 3200 has a projection 3210 engaging the holder 2600, while the holder 2600 has a depression caught by the projection on either side to prevent the falling by engagement of both.

Figure 28:
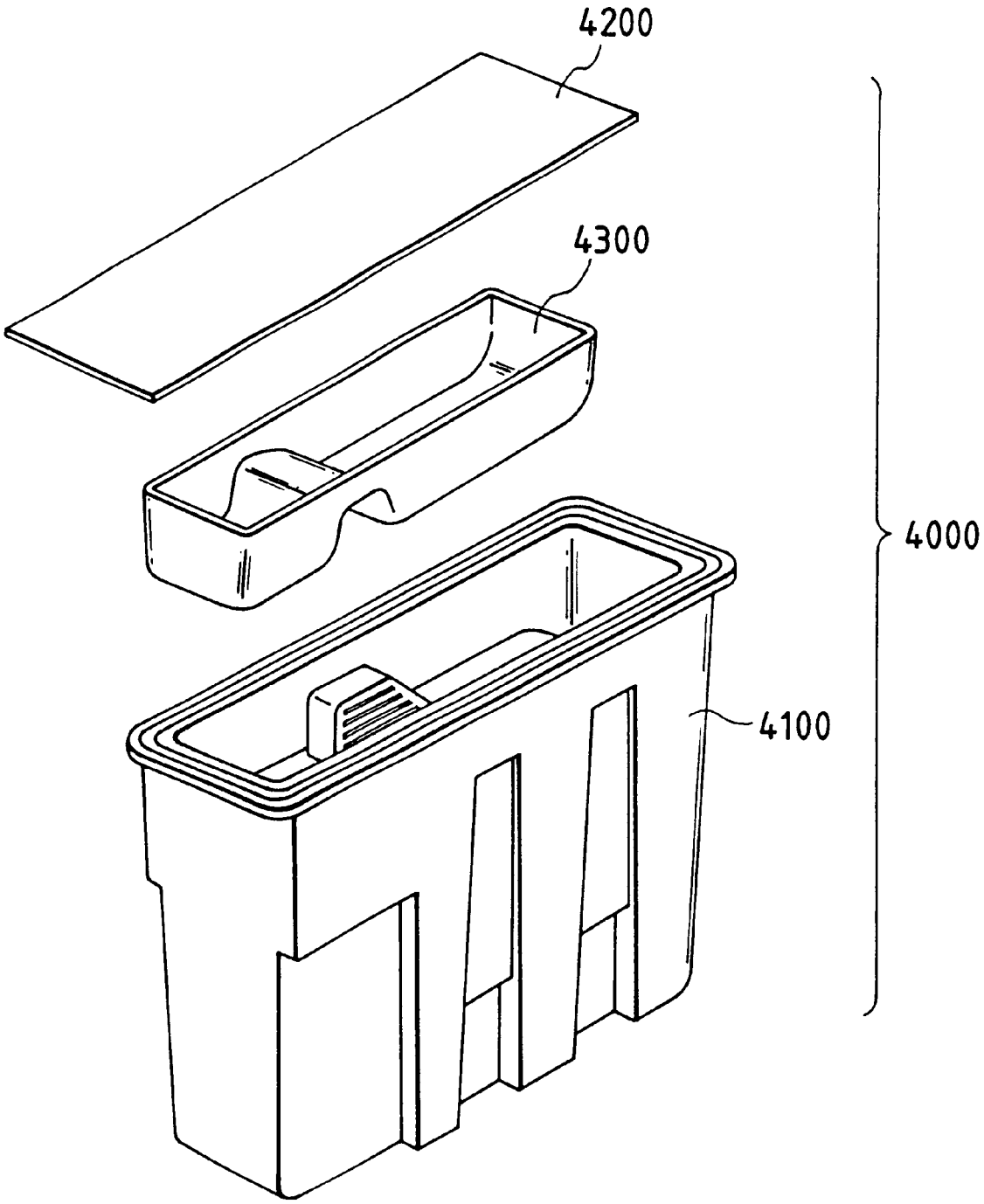
FIG. 28 is an exploded perspective view showing the constitution of a package applicable to the ink jet cartridge as shown in FIGS. 13 to 16.

FIG. 28 shows the constitution of a package 4000 for protecting the ink jet cartridge against the physical distribution environment changes, and preventing the falling. In FIG. 28, 4100 is a case body, 4200 is a case lid, and 4300 is a buffer body for preventing the vibration of the ink jet cartridge within the case.

The case body 4100 is formed of a molding made of polypropylene from the aspects of impact durability, gas barrier property of preventing evaporation of the ink from the ink jet cartridge, as well as the costs. The case lid 4200 is formed of a multi-layer film having excellent gas barrier property, for example, one in which a polyethylene terephthalate layer 12 μm, an aluminum evaporation layer 0.05 μm, a nylon layer 15 μm, a polyethylene layer 25 μm, an easy peel layer 25 μm are laminated in sequence from the outermost layer or the outside, or one in which a nylon 15 μm, an aluminum foil 9 μm and an easy peel layer 75 μm are laminated in sequence from the outermost layer.

The packaging procedure is as follows.

After inserting the ink jet cartridge into the case body 4100, the buffer body 4300 is placed therein, a welding rib 4120 disposed in a flange portion 4110 of the case body 4100 and the easy peel layer of the case lid 4200 are welded together by heating to obtain a package.

Figure 29:
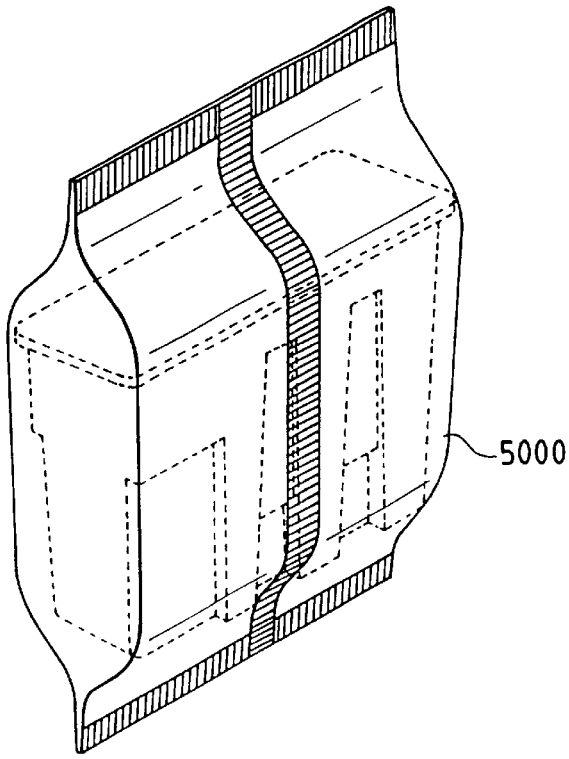
FIG. 29 is a perspective view showing a final package of the ink jet cartridge received within the package as shown in FIG. 28.

Further, this package 4000 is accommodated within a pillow bag 5100 fancy printed, and then a package 5000 of the ink jet recording head is completed (see FIG. 29). In the above example, a head cartridge with an ink tank unit and a head unit integrated was described below, but the head unit and the ink tank unit may be separated as independent parts.

(Other Embodiment)

Figure 30:
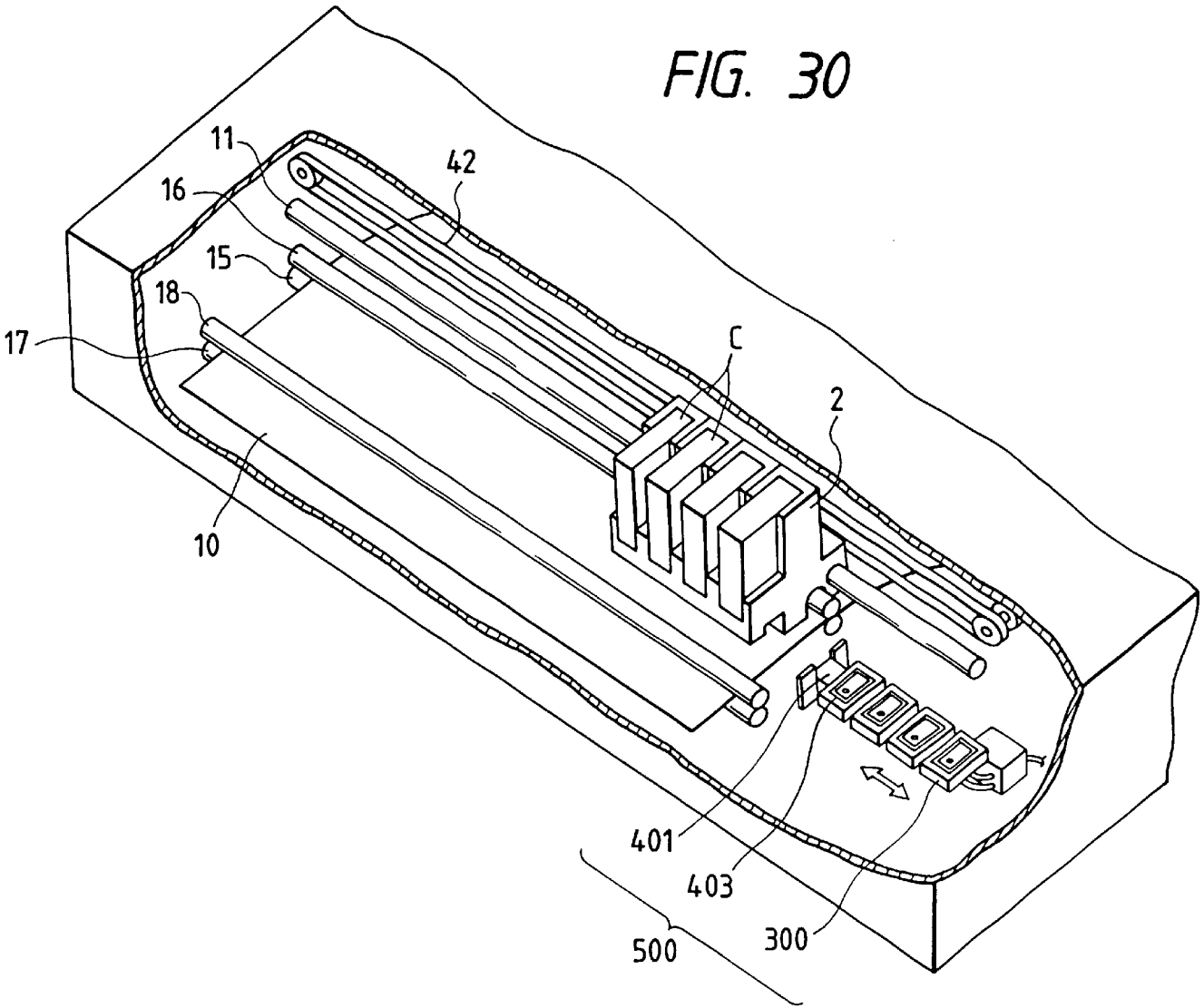
FIG. 30 is a perspective view showing one example of an ink jet apparatus on which an ink jet cartridge of the present invention can be mounted.

FIG. 30 shows one embodiment of an ink jet recording apparatus having an ink jet cartridge mounted thereon according to the present invention.

In the figure, C is an ink jet cartridge of the present invention, as previously described, and 2 is a carriage for mounting for the movement four ink jet cartridges corresponding to four color inks of yellow, magenta, cyan and black.

Herein, the carriage 2 is slidably engaged in a guide shaft 11, a part of the carriage 2 being connected to a belt 42 driven by a motor. Thereby, the carriage 2 is movable along the guide shaft 11, allowing the ink jet cartridge C to be moved in the recording area and its adjacent area.

15, 16 are feed rollers for driving the motor. With such constitution, a recording medium 10 is supplied to a position opposite the discharge port face of the recording head, and fed via rollers 17, 18 into a paper exhaust portion when the recording is progressed.

In this embodiment, the recording medium 10 is conveyed along a conveying direction (sub-scan direction) by the feed rollers, and after the recording medium 10 is set at predetermined recording position, the operation of recording (scanning) an image by the ink jet cartridge C mounted on the carriage 2 which moves along the recording medium 10, feeding (pitch conveying) the sheet by a predetermined amount after recording one line, and then recording (scanning) the image at the next line is repeated, until the entire image is recorded for the recording medium.

401 is a blade as the wiping member, one end thereof being held by a blade holding member to become a secured end, and taking a form of cantilever. The blade 401 is disposed at a position adjacent the recording area with the recording head, and in this embodiment, held in the projected form into the course of movement of the recording head.

300 is a cap which is disposed at a home position contiguous to the blade 401 and movable back and forth in the directions perpendicular to the moving direction of the recording head to make direct contact with the discharge port face, thereby effecting the capping. Further, 403 is an absorbing member provided adjacent the blade 401, which is held, like the blade 401, in the projected form into the course of movement of the recording head.

A discharge port recovery portion 500 is constituted of the blade 401, the cap 300 and the absorbing member 403, wherein the ink and the dirt sticking to the ink discharge port face can be removed by the blade 401 and the absorbing member 403.

With the above constitution, when the ink jet cartridge C returns to the home position after completion of the recording, the cap 300 of the discharge port recovery portion 500 of the recording head is retreated from the movement passage of the ink jet cartridge C, but the blade 401 is projected into the movement course. As a result, the discharge port face of the ink jet cartridge C is wiped by the blade 401 projected therefrom.

Also, when the cap 300 makes direct contact with the discharge port face of the ink jet cartridge to effect the capping, the cap 300 is moved to project into the course of movement of the cartridge. When the cartridge C is moved from the home position to the start position of recording, the cap 300 and the blade 401 are located at the same position as in the wiping as above described. As a result, upon the movement before starting the recording, the discharge port face of the cartridge C is wiped.

The recovery of the discharge port portion of the recording head with the blade is performed at a predetermined interval not only during the movement of the carriage before and after the recording, but also during the recording.

Note that the ink sticking to this blade 401 with the recovery is receivable by the ink absorbing member 104 (see FIG. 1A) on the head side as previously described.

When the ink jet cartridge of the present invention is used for the recording apparatus as above, the height H of the ink jet cartridge will not increase with the increased receivable amount of ink, in the attitude of mounting it on the carriage, because the ink receivable amount of the ink tank unit is increased by raising the ink filling ratio in the present invention.

The present invention makes it possible to reduce the total thickness because of no porous member disposed in the ink storing portion, and reduce the size of the carriage, when a plurality of ink jet cartridges such as for a color recording apparatus are arranged side-by-side as shown in FIG. 11.

The embodiment employs a recording head or a recording device of the ink jet recording system of performing the recording by forming flying liquid droplets by the use of the heat energy among the various ink jet recording systems, but is conveniently usable in other constitution of flying liquid droplets.

Its representative consitution and principle of the ink jet system using the heat energy are disclosed in, for example, U.S. Pat. Nos. 4,723,129 and 4,740,796, and it is preferred that the present invention is practiced using these basic principles. This recording system is applicable to either of the so-called on-demand type and the continuous type.

Briefly stating this recording system, by applying at least one driving signal which gives rapid temperature elevation exceeding nucleate boiling and causing film boiling phenomenon in the ink corresponding to the recording information to electrothermal converters arranged corresponding to the liquid channels holding a liquid (ink), heat energy is generated to effect film boiling at the heat acting surface of the recording head.

Thus, because the bubbles within the liquid (ink) can be formed corresponding one by one to the driving signals which are applied to the electrothermal converters, the recording system of the on demand type is especially effective. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. No. 4,313,124 of the invention concerning the temperature elevation rate of the above-mentioned heat acting surface.

As the constitution of the recording head, in addition to the combination of the discharging port, liquid channel, and electrothermal converter (linear liquid channel or right-angled liquid channel) as. disclosed in the above-mentioned respective specifications, the constitution by use of U.S. Pat. Nos. 4,558,333 and 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electrothermal converters as the discharging port of the electrothermal converter or Japanese Laid-Open Patent Application No. 59-138461 which discloses the consitution having the opening for absorbing pressure wave of heat energy correspondent to the discharging portion.

Further, as the recording mode of the recording device, the present invention is extremely effective for not only the recording mode only of a primary color such as black, etc., but also a device equipped with at least one plural different colors or full color by color mixing, whether the recording head may be either integrally constituted or combined in plural number.

In the ink jet head cartridge of the present invention, because the atmosphere communicating port of the negative pressure generating member receiving portion of the ink tank and the ink supply port are disposed on the opposed surfaces, with the atmosphere communicating port located above the ink supply port, the state where no ink resides near the atmosphere communicating port even with the ink accumulated near the ink supply port is easy to hold, and the ink leakage is less likely to occur.

In addition, owing to the action of the negative pressure generating member as the buffer in the state of having ink wetness only near the ink supply port but not in the remaining portion, the ink leakage is less likely to occur, because no ink is reserved in the space portion even if the ink runs along the interstice produce by exfoliation or distortion at the angled portion of the negative pressure generating member (ink absorbing member).

Further, in the cartridge of the present invention, by shaping the ink storing portion like an L-character of ⊐-character, the volume of the ink storing portion can be made greater than that of the negative pressure generating member receiving portion, whereby the reduction in the running cost can be realized without increasing the size of the ink tank.

Still further, in the cartridge of the present invention, by rounding the edge angled portion within the negative pressure generating member receiving portion to make four corners curved, the exfoliation or distortion at the angled portion of the negative pressure generating member can be suppressed in inserting the negative pressure generating member, resulting in no gap between the ink storing portion and the negative pressure generating member, whereby the ink is concentrated in the neighborhood of the ink supply port, without the ink flowing near the atmosphere communicating port located upward, and ink leakage can be prevented beforehand.

And by providing a groove portion having a height of the top of less than 5 mm from the filter face at the end portion of the ink communicating member of the ink jet head unit on the partition wall within the ink cartridge for the ink jet, the ink supply to the recording head can be performed stably and highly reliably.

Also, by providing a recess portion on the bottom portion of the negative pressure generating member (ink absorbing member) receiving portion of the ink cartridge for the ink jet, the ink flow passage can be secured more widely, resulting in no ink interruption.

Further, with the present invention, by dividing one aperture of the atmosphere communicating port into two or more openings, the necessity of providing the multiplicity of parts or the inconformity with the molding as conventionally occurs can be improved, and the structure of atmosphere communicating port with high productivity and reliability can be obtained, which is applicable to the ink storing vessel using the negative pressure generating member, whether the division-type or the integral-type.

With a recording head having integrally an ink tank portion having first and second accommodating chambers and an ink discharge portion, there is the effect that the stabler gas-liquid interface in supplying the ink within the ink chamber in the ink tank portion to the negative pressure generating member, as well as the stabler supply of the ink, can be achieved.

Also, by making the vertical edge lines of the first accommodating chamber and the second accommodating chamber a curved shape, and providing a projection on the bottom surface of the second accommodating chamber near the minute communicating portion, there is the effect that the ink leakage through the atmosphere communicating port due to changes in the attitude during physical distribution or changes in the environmental temperature or humidity can be prevented.

As above described, with the present invention, an ink jet head cartridge with a large ink storage capacity can be provided with high reliability in preventing ink leakage and ink exhaustion, and an ink jet recording apparatus capable of the excellent printing for the long term can be provided.

What is claimed is:

1. A liquid accommodating container connected to an ink jet head and accommodating a liquid supplied to said ink jet head, said container comprising:

a partition for dividing said liquid accommodating container into a first chamber and a second chamber, said first chamber having a supply portion for supplying the liquid to said ink jet head and an atmosphere communicating section communicated with an atmospheric air, and said second chamber being communicated with said first chamber through a liquid communicating section and being substantially sealed except said liquid communicating section, said second chamber accommodating the liquid to be supplied to said first chamber; and a negative pressure generating member inserted into and held by said first chamber with compression;

wherein said first chamber has a cross-section of substantially rectangular shape taken along a plane perpendicular to a direction of insertion of said negative pressure generating member, and inside corners of said rectangular shape are curved with the curved corners extending in the direction of insertion;

wherein said negative pressure generating member is compressed in a direction of insertion; and wherein the curved corners of said first chamber are contacted by said negative pressure generating member, which is compressed by the curved corners.

2. A liquid accommodating container according to claim 1, wherein said atmosphere communicating section is provided at a position at which the liquid supply direction from the second chamber to the first chamber is orthogonal to a scanning direction in which said liquid accommodating container is movable during discharging of liquid.

3. A liquid accommodating container according to claim 1 or 2, wherein said first chamber has a recess portion between said supply portion and said atmosphere communicating section.

4. A liquid accommodating container according to claim 1 or 2, wherein said partition has a groove portion leading to said atmosphere communicating section on the side of said first chamber.

5. A liquid accommodating container according to claim 1 or 2, wherein said first chamber has an atmosphere communicating port at a position opposite said supply portion.

6. A liquid accommodating container according to claim 1 or 2, wherein said first chamber has at least two or more negative pressure generating members.

7. A liquid accommodating container according to claim 1, wherein said ink jet head discharges ink in a discharge direction, and wherein said atmosphere communicating section is provided at a position which differs in the discharge direction from that of said supply portion.

8. An ink jet cartridge comprising:

an ink jet head; and an ink accommodating container connected to said ink jet head unit for accommodating an ink supplied to said ink jet head, said container comprising:

a partition for dividing said ink accommodating container into a first chamber and a second chamber, said first chamber having a supply portion for supplying the ink to said ink jet head and an atmosphere communicating section communicated with an atmospheric air, and said second chamber being communicated with said first chamber through a liquid communicating section and being substantially sealed except said liquid communicating section, said second chamber accommodating the ink to be supplied to said first chamber; and a negative pressure generating member inserted into and held by said first chamber with compression;

wherein said first chamber has a cross-section of substantially rectangular shape taken along a plane perpendicular to a direction of insertion of said negative pressure generating member, and inside corners of the rectangular shape are curved with the curved corners extending in the direction of insertion, wherein said negative pressure generating member is compressed in a direction crossing with the direction of insertion, and wherein the curved corners of said first chamber are contacted by said negative pressure generating member, which is compressed by the curved corners.

9. An ink jet cartridge according to claim 8, wherein said atmosphere communicating section is provided at a position at which the ink supply direction from the second chamber to the first chamber is orthogonal to a scanning direction in which said ink accommodating container is movable during discharging of liquid.

10. An ink jet cartridge according to claim 8 or 9, wherein said first chamber has a recess portion between said supply portion and said atmosphere communicating section.

11. An ink jet cartridge according to claim 8 or 9, wherein said partition has a groove portion leading to said atmosphere communicating section on the side of said first chamber.

12. An ink jet cartridge according to claim 8 or 9, wherein said first chamber has an atmosphere communicating port at a position opposite said supply portion.

13. An ink jet cartridge according to claim 8 or 9, wherein said first chamber has at least two or more negative pressure generating members.

14. An ink jet cartridge according to claim 8, wherein said ink jet head discharges ink in a discharge direction, and wherein said atmosphere communicating section is provided at a position which differs in the discharge direction from that of said supply portion.

15. An ink jet cartridge according to claim 8, wherein said ink jet head has electrothermal converters for causing the discharging of liquid in such a manner as to cause a state change in the ink by generating the heat with electrical energy supplied to discharge the ink.

16. An ink jet cartridge according to claim 8, wherein said ink jet head has electrothermal converters for causing the discharging of liquid in such a manner as to cause a state change in the ink by generating the heat with electrical energy supplied to discharge the ink, and wherein said ink jet head has an ink communicating member which is inserted into said supply portion, the distance from an end portion of said ink communicating member to an upper end of a groove portion extending from said liquid communicating section being within 5 mm.

17. An ink jet apparatus comprising:

an ink jet cartridge comprising an ink jet head and an ink accommodating container connected thereto;

a carriage for detachably mounting said ink jet cartridge; and conveying means for conveying a recording medium which accepts ink discharged from said ink jet head;

wherein said ink accommodating container comprises:

a partition for dividing said ink accommodating container into a first chamber and a second chamber, said first chamber having a supply portion for supplying the ink to said ink jet head and an atmosphere communicating section communicated with an atmospheric air, and said second chamber being communicated with said first chamber through a liquid communicating section and being substantially sealed except said liquid communicating section, said second chamber accommodating the ink to be supplied to said first chamber; and a negative pressure generating member inserted into and held by said first chamber with compression;

wherein said first chamber has a cross-section of substantially rectangular shape taken along a plane perpendicular to a direction of insertion of said negative pressure generating member, and inside corners of the rectangular shape are curved with the curved corners extending in the direction of insertion, wherein said negative pressure generating member is compressed in a direction crossing with the direction of insertion, and wherein the curved corners of said first chamber are contacted by said negative pressure generating member, which is compressed by the curved corners.

18. An ink jet apparatus according to claim 17, wherein said atmosphere communicating section is provided at a position at which the ink supply direction from the second chamber to the first chamber is orthogonal to a scanning direction in which said ink accommodating container is movable during discharging of liquid.

19. An ink jet apparatus according to claim 17 or 18, wherein said first chamber has a recess portion between said supply portion and said atmosphere communicating section.

20. An ink jet apparatus according to claim 17 or 18, wherein said partition has a groove portion leading to said atmosphere communicating section on the side of said first chamber.

21. An ink jet apparatus according to claim 17 or 18, wherein said first chamber has an atmosphere communicating port at a position opposite said supply portion.

22. An ink jet apparatus according to claim 17 or 18, wherein said first chamber has at least two or more negative pressure generating members.

23. An ink jet apparatus according to claim 17, wherein said ink jet head discharges ink in a discharge direction, and wherein said atmosphere communicating section is provided at a position which differs in the discharge direction from that of said supply portion.

24. An ink jet apparatus according to claim 17, wherein said ink jet head has electrothermal converters for causing the discharging of liquid in such a manner as to cause a state change in the ink by generating the heat with electrical energy supplied to discharge the ink.

25. An ink jet apparatus according to claim 17, wherein said ink jet head has electrothermal converters for causing the discharging of liquid in such a manner as to cause a state change in the ink by generating the heat with electrical energy supplied to discharge the ink, and wherein said ink jet head has an ink communicating member which is inserted into said supply portion, the distance from an end portion of said ink communicating member to an upper end of a groove portion extending from said liquid communicating section being within 5 mm.

26. An ink container unit for supplying ink to an ink jet head, comprising:

an accommodating portion for accommodating an ink retaining member inserted under compression, said ink retaining member having an elasticity and having a number of pores for retaining the ink;

wherein said accommodating portion has a cross-section of substantially rectangular shape taken along a plane perpendicular to a direction of insertion of said ink retaining member, and inside corners of the rectangular shape are curved to prevent deformation of said ink retaining member when it is inserted into said accommodating portion with compression, with the curved corners extending in the direction of insertion, wherein said ink retaining member is compressed in a direction crossing with the direction of insertion, and wherein the curved corners of said accommodating portion are contacted by said ink retaining member, which is compressed by the curved corners.

27. An ink container unit according to claim 26, wherein said accommodating portion is provided with an ink supply portion for supplying the ink to said ink jet head and an atmosphere communicating portion for communicating with an atmospheric air, said ink container unit further comprising an ink reservoir portion which is in communication with said accommodating portion through a communicating section and being substantially sealed except said communicating section, said reservoir portion containing the ink to be supplied to said accommodating portion.

* * * * *

UNITED STATES PATENT AND TRADEMARK OFFICE

CERTIFICATE OF CORRECTION

PATENT NO. : 6,431,696 B1
DATED : August 13, 2002
INVENTOR(S) : Hiroki Tajima et al.

It is certified that error appears in the above-identified patent and that said Letters Patent is hereby corrected as shown below:

Title page,
Item [57], ABSTRACT,
Line 9, "The portion" should read -- The partition portion --; and Item [56], References Cited, FOREIGN PATENT DOCUMENTS,
"JP 57-16385 6/1955" should read -- JP 57-16385 6/1982 --; and
"JP 2-522 1/1998" should read -- JP 2-522 1/1990 --.

Column 1,
Line 47, "celling" should read -- ceiling --; and
Line 67, "to" should be deleted.

Column 2,
Line 1, "to" should be deleted.

Column 5,
Line 1, "extening" should read -- extending --;
Line 54, "view" should read -- view of --; and
Line 64, "in, which" should read -- in which --.

Column 6,
Line 38, "unit" should read -- unit, --; and
Line 46, "head" should read -- head unit --.

Column 8,
Line 23, "2B", should read -- 2B, --; and
Line 24, "cartidge" should read -- cartridge --.

Column 13,
Line 61, "father" should read -- farther --.

Column 16,
Line 66, "accomodating" should read -- accommodating --.

Column 17,
Line 29, "modling" should read -- molding --; and
Line 54, "splender" should read -- slender --.

UNITED STATES PATENT AND TRADEMARK OFFICE

CERTIFICATE OF CORRECTION

PATENT NO. : 6,431,696 B1
DATED : August 13, 2002
INVENTOR(S) : Hiroki Tajima et al.

It is certified that error appears in the above-identified patent and that said Letters Patent is hereby corrected as shown below:

Column 18,
Line 13, “a adhesive” should read -- an adhesive --.

Column 19,
Line 12, “maintained, in” should read -- maintained in --.

Column 20,
Line 44, “portion” should read -- portions --.

Column 21,
Line 7, “1300. With” should read -- 1300 with --.

Column 22,
Line 6, “compressed” should read -- being compressed --.

Column 23,
Line 33, “a” should read -- an --.

Column 27,
Line 6, “of” should read -- or --.

Signed and Sealed this

Eighteenth Day of March, 2003

JAMES E. ROGAN
*Director of the United States Patent and Trademark Office*